US007628479B2

(12) United States Patent
Takagi

(10) Patent No.: US 7,628,479 B2
(45) Date of Patent: Dec. 8, 2009

(54) INK-JET RECORDING APPARATUS INCLUDING PUMP, METHOD FOR CONTROLLING THE INK-JET RECORDING APPARATUS, AND METHOD FOR CONTROLLING THE PUMP

(75) Inventor: Osamu Takagi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 175 days.

(21) Appl. No.: 11/703,747

(22) Filed: Feb. 8, 2007

(65) Prior Publication Data

US 2007/0139490 A1 Jun. 21, 2007

Related U.S. Application Data

(62) Division of application No. 10/948,195, filed on Sep. 24, 2004, now Pat. No. 7,322,682.

(30) Foreign Application Priority Data

Sep. 25, 2003 (JP) ..... 2003-333181

(51) Int. Cl.
*B41J 2/175* (2006.01)

(52) U.S. Cl. ..... 347/85

(58) Field of Classification Search ..... 347/85
See application file for complete search history.

(56) References Cited

U.S. PATENT DOCUMENTS 2,353,965 A 7/1944 Meador
4,133,617 A * 1/1979 Reynaud ..... 418/150
5,159,348 A * 10/1992 Dietl et al. ..... 347/89

FOREIGN PATENT DOCUMENTS

| | | |
|---|---|---|
| EP | 0 558 294 A2 | 9/1993 |
| EP | 0 589 541 A1 | 3/1994 |
| EP | 0 818 317 A2 | 1/1998 |
| EP | 1 454 755 A1 | 9/2004 |
| GB | 2 158 517 A | 11/1985 |

(Continued)

*Primary Examiner*—Stephen D Meier
*Assistant Examiner*—Geoffrey Mruk
(74) *Attorney, Agent, or Firm*—Oliff & Berridge, PLC

(57) ABSTRACT

An ink-jet recording apparatus has a pump, an ink-jet head, and a detector. The pump includes a housing, a rotor, a partition, a first passage, and a second passage. The housing has a cavity formed therein and also has an inlet port through which ink is sucked into the cavity and an outlet port through which ink is discharged out of the cavity. The rotor is rotatable within the cavity. The partition is, together with the rotor, rotatable within the cavity while being supported on the rotor such that both ends thereof can be in contact with an inner surface of the housing. The first passage is formed within the cavity and extends from the inlet port to the outlet port. The second passage is formed within the cavity to be longer than the first passage and extends from the inlet port to the outlet port via a side of the rotor opposite to the first passage. To the ink-jet head, ink is supplied from the pump. The detector detects whether or not the partition is disposed within such a range that a flow resistance in the first passage can be higher than a flow resistance in the second passage.

3 Claims, 11 Drawing Sheets

FOREIGN PATENT DOCUMENTS

| | | | |
|---|---|---|---|
| JP | 03-164262 | * | 7/1991 |
| JP | A 04-053754 | | 2/1992 |
| JP | B2 07-080304 | | 8/1995 |
| WO | WO 98/03794 | | 1/1998 |
| WO | WO 98/42984 | | 10/1998 |

* cited by examiner

INK-JET RECORDING APPARATUS INCLUDING PUMP, METHOD FOR CONTROLLING THE INK-JET RECORDING APPARATUS, AND METHOD FOR CONTROLLING THE PUMP

This is a Division of application Ser. No. 10/948,195 filed Sep. 24, 2004. The disclosure of the prior application is hereby incorporated by reference herein in its entirety.

BACKGROUND OF THE INVENTION

1. Field of the Invention

The present invention relates to an ink-jet recording apparatus comprising a pump that sucks liquid therein and discharges the liquid thereout, to a method for controlling the ink-jet recording apparatus, and to a method for controlling the pump.

2. Description of Related Art

An ink-jet recording apparatus such as ink-jet printers comprises an ink-jet head formed with a large number of nozzles through which ink is ejected. The ink-jet head is connected, through a tube or the like, with an ink cartridge that serves as an ink supply source. During a printing operation, the ink-jet head sucks ink from the ink cartridge by making use of a capillary effect within the nozzles and a difference between the ink cartridge and the nozzles in pressure acting thereon. Then, the ink is ejected through the nozzles, so that an image is recorded onto a record medium such as papers.

However, air bubbles sometimes arise in the tube while, e.g., renewing the ink cartridge. When these air bubbles stay within the tube, suction of ink from the ink cartridge into the head becomes troublesome, which may adversely affect a recording onto a record medium.

As a means for solving the aforementioned problem, known is a technique in which a pump having two tubes passing therethrough is disposed between a head and an ink cartridge and the pump performs a purge operation using one of the two tubes (see Japanese Patent Publication No. 7-80304). The purge operation allows ink containing air bubbles to be discharged, through the nozzles, out of the tube or out of an ink passage of the head.

In this technique, the pump includes a housing in which a cylindrical cavity is formed, and a rotor rotatably mounted within the cavity. Three rollers are rotatably journaled to the rotor. These three rollers are disposed apart by the same angle from one another in a circumferential direction. A diameter of the rotor is smaller than a diameter of the cylindrical cavity in the housing, thus forming a space between the rotor and an inner wall of the housing. The two tubes are disposed through upper and lower portions of this space. The upper tube, which connects the head with the ink cartridge, constitutes an ink supply path. The lower tube, which connects a waste ink tank with a purge cap for covering a nozzle face of the head, constitutes an ink discharge path. The lower tube contributes to the purge operation.

SUMMARY OF THE INVENTION

In the above-described technique, however, when ink is forcibly supplied to the head during the purge operation or the like, the rollers of the rotor repeatedly applies alternating pressurization and depressurization onto the upper tube that constitutes the ink supply path. This causes damage on the tube, which means a failure of the pump, and therefore raises a problem that ink cannot smoothly be supplied to the ink-jet head.

An object of the present invention is to provide an ink-jet recording apparatus comprising a pump that is unlikely to cause a failure, a method for controlling the ink-jet recording apparatus capable of preventing a failure of the pump, and a method for controlling the pump capable of preventing a failure.

According to a first aspect of the present invention, there is provided an ink-jet recording apparatus comprising a pump, an ink-jet head, and a detector. The pump includes a housing, a rotor, a partition, a first passage, and a second passage. The housing has a cavity formed therein and also has an inlet port through which ink is sucked into the cavity and an outlet port through which ink is discharged out of the cavity. The rotor is rotatable within the cavity. The partition is, together with the rotor, rotatable within the cavity while being supported on the rotor such that both ends thereof can be in contact with an inner surface of the housing. The first passage is formed within the cavity and extends from the inlet port to the outlet port. The second passage is formed within the cavity to be longer than the first passage and extends from the inlet port to the outlet port via a side of the rotor opposite to the first passage. To the ink-jet head, ink is supplied from the pump. The detector detects whether or not the partition is disposed within such a range that a flow resistance in the first passage can be higher than a flow resistance in the second passage.

According to a second aspect of the present invention, there is provided an ink-jet recording apparatus comprising a pump, an ink-jet head, and a detector. The pump includes a housing, a rotor, a partition, a first passage, and a second passage. The housing has a cavity formed therein and also has an inlet port through which ink is sucked into the cavity and an outlet port through which ink is discharged out of the cavity. The rotor is rotatable within the cavity. The partition is, together with the rotor, rotatable within the cavity while being supported on the rotor such that both ends thereof can be in contact with an inner surface of the housing. The first passage is formed within the cavity and extends from the inlet port to the outlet port. The second passage is formed within the cavity to be longer than the first passage and extends from the inlet port to the outlet port via a side of the rotor opposite to the first passage. To the ink-jet head, ink is supplied from the pump. The detector detects whether or not the partition is disposed within such a range that a ratio of a flow resistance in the second passage to a flow resistance in the first passage can be lower than the one obtained when the ink-jet head is performing a recording.

According to a third aspect of the present invention, there is provided an ink-jet recording apparatus comprising a pump, an ink-jet head, and a detector. The pump includes a housing, a rotor, a partition, a first passage, and a second passage. The housing has a cavity formed therein and also has an inlet port through which ink is sucked into the cavity and an outlet port through which ink is discharged out of the cavity. The rotor is rotatable within the cavity. The partition is, together with the rotor, rotatable within the cavity while being supported on the rotor such that both ends thereof can be in contact with an inner surface of the housing. The first passage is formed within the cavity and extends from the inlet port to the outlet port. The second passage is formed within the cavity to be longer than the first passage and extends from the inlet port to the outlet port via a side of the rotor opposite to the first passage. To the ink-jet head, ink is supplied from the pump. The detector detects whether or not the partition is disposed within such a range that a flow resistance in the first passage can be higher than the one obtained when the ink-jet head is performing a recording.

According to a fourth aspect of the present invention, there is provided a method for controlling an ink-jet recording apparatus comprising a pump and an ink-jet head. The pump includes a housing, a rotor, a partition, a first passage, and a second passage. The housing has a cavity formed therein and also has an inlet port through which ink is sucked into the cavity and an outlet port through which ink is discharged out of the cavity. The rotor is rotatable within the cavity. The partition is, together with the rotor, rotatable within the cavity while being supported on the rotor such that both ends thereof can be in contact with an inner surface of the housing. The first passage is formed within the cavity and extends from the inlet port to the outlet port. The second passage is formed within the cavity to be longer than the first passage and extends from the inlet port to the outlet port via a side of the rotor opposite to the first passage. To the ink-jet head, ink is supplied from the pump. The method comprises steps of: disposing the partition within such a range that a flow resistance in the first passage can be higher than a flow resistance in the second passage; and starting an initial ink introduction into the cavity.

According to a fifth aspect of the present invention, there is provided a method for controlling an ink-jet recording apparatus comprising a pump and an ink-jet head. The pump includes a housing, a rotor, a partition, a first passage, and a second passage. The housing has a cavity formed therein and also has an inlet port through which ink is sucked into the cavity and an outlet port through which ink is discharged out of the cavity. The rotor is rotatable within the cavity. The partition is, together with the rotor, rotatable within the cavity while being supported on the rotor such that both ends thereof can be in contact with an inner surface of the housing. The first passage is formed within the cavity and extends from the inlet port to the outlet port. The second passage is formed within the cavity to be longer than the first passage and extends from the inlet port to the outlet port via a side of the rotor opposite to the first passage. To the ink-jet head, ink is supplied from the pump. The method comprises steps of: disposing the partition within such a range that a ratio of a flow resistance in the second passage to a flow resistance in the first passage can be lower than the one obtained when the ink-jet head is performing a recording; and starting an initial ink introduction into the cavity.

According to a sixth aspect of the present invention, there is provided a method for controlling an ink-jet recording apparatus comprising a pump and an ink-jet head. The pump includes a housing, a rotor, a partition, a first passage, and a second passage. The housing has a cavity formed therein and also has an inlet port through which ink is sucked into the cavity and an outlet port through which ink is discharged out of the cavity. The rotor is rotatable within the cavity. The partition is, together with the rotor, rotatable within the cavity while being supported on the rotor such that both ends thereof can be in contact with an inner surface of the housing. The first passage is formed within the cavity and extends from the inlet port to the outlet port. The second passage is formed within the cavity to be longer than the first passage and extends from the inlet port to the outlet port via a side of the rotor opposite to the first passage. To the ink-jet head, ink is supplied from the pump. The method comprises steps of: disposing the partition within such a range that a flow resistance in the first passage can be higher than the one obtained when the ink-jet head is performing a recording; and starting an initial ink introduction into the cavity.

According to a seventh aspect of the present invention, there is provided a method for controlling a pump that includes a housing, a rotor, a partition, a first passage, and a second passage. The housing has a cavity formed therein and also has an inlet port through which liquid is sucked into the cavity and an outlet port through which liquid is discharged out of the cavity. The rotor is rotatable within the cavity. The partition is, together with the rotor, rotatable within the cavity while being supported on the rotor such that both ends thereof can be in contact with an inner surface of the housing. The first passage is formed within the cavity and extends from the inlet port to the outlet port. The second passage is formed within the cavity to be longer than the first passage and extends from the inlet port to the outlet port via a side of the rotor opposite to the first passage. The method comprises steps of: disposing the partition within such a range that a flow resistance in the first passage can be higher than a flow resistance in the second passage; and starting an initial liquid introduction into the cavity.

According to an eighth aspect of the present invention, there is provided an ink-jet recording apparatus comprising a pump, an ink-jet head, and a detector. The pump includes a housing, a rotor, a partition, a first passage, and a second passage. The housing has a cavity formed therein and also has an inlet port through which ink is sucked into the cavity and an outlet port through which ink is discharged out of the cavity. The rotor is rotatable within the cavity. The partition is, together with the rotor, rotatable within the cavity while being supported on the rotor such that both ends thereof can be in contact with an inner surface of the housing. The first passage is formed within the cavity and extends from the inlet port to the outlet port. The second passage is formed within the cavity to be longer than the first passage and extends from the inlet port to the outlet port via a side of the rotor opposite to the first passage. To the ink-jet head, ink is supplied from the pump. The detector detects whether or not the partition is disposed within such a range that the sum of flow resistances in the first and second passages can be higher than the one obtained when the ink-jet head is performing a recording.

According to a ninth aspect of the present invention, there is provided a method for controlling an ink-jet recording apparatus comprising a pump and an ink-jet head. The pump includes a housing, a rotor, a partition, a first passage, and a second passage. The housing has a cavity formed therein and also has an inlet port through which ink is sucked into the cavity and an outlet port through which ink is discharged out of the cavity. The rotor is rotatable within the cavity. The partition is, together with the rotor, rotatable within the cavity while being supported on the rotor such that both ends thereof can be in contact with an inner surface of the housing. The first passage is formed within the cavity and extends from the inlet port to the outlet port. The second passage is formed within the cavity to be longer than the first passage and extends from the inlet port to the outlet port via a side of the rotor opposite to the first passage. To the ink-jet head, ink is supplied from the pump. The method comprises steps of: disposing the partition within such a range that the sum of flow resistances in the first and second passages can be higher than the one obtained when the ink-jet head is performing a recording; and dismounting from the pump an ink supply member that supplies ink to the pump.

According to a tenth aspect of the present invention, there is provided a method for controlling a pump that includes a housing, a rotor, a partition, a first passage, and a second passage. The housing has a cavity formed therein and also has an inlet port through which liquid is sucked into the cavity and an outlet port through which liquid is discharged out of the cavity. The rotor is rotatable within the cavity. The partition is, together with the rotor, rotatable within the cavity while being supported on the rotor such that both ends thereof can be in contact with an inner surface of the housing. The first passage is formed within the cavity and extends from the inlet port to the outlet port. The second passage is formed within the cavity to be longer than the first passage and extends from the inlet port to the outlet port via a side of the rotor opposite to the first passage. The method comprises steps of: disposing the partition within such a range that the sum of flow resistances in the first and second passages can be higher than the one obtained when the ink-jet head is performing a recording; and dismounting from the pump an ink supply member that supplies ink to the pump.

The apparatuses or methods according to the aforementioned first to tenth aspects do not adopt such a system that, as in the prior art, a tube disposed within a pump is subjected to repeated pressurization and depressurization. Therefore, the pump has a relatively simple construction, and at the same time the pump is unlikely to incur a failure that would otherwise be caused by, e.g., damage on a tube. Thus, the ink-jet head can be prevented from seeing a defective ink supply that would be caused by a failure of the pump.

In the apparatuses or methods according to the aforementioned first to seventh aspects, based on a result of detection by the detector, the partition is disposed within the above-described ranges prior to introducing ink into the empty cavity of the pump, and then ink can be introduced into the cavity with the partition being kept within the above-described ranges. As a result, air, which has already existed in the cavity prior to the ink introduction, is pushed by ink and smoothly moved toward the outlet port. Therefore, air bubbles are unlikely to arise within the cavity.

Further, in the apparatus or methods according to the aforementioned eighth to tenth aspects, based on a result of detection by the detector, the partition is disposed within the above-described ranges prior to dismounting from the pump the ink supply member that supplies ink to the pump, and then the ink supply member is dismounted from the pump with the partition being kept within the above-described ranges. As a result, pressure within the cavity can substantially be kept constant during a dismounting of the ink supply member. This can prevent breakage of meniscuses.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
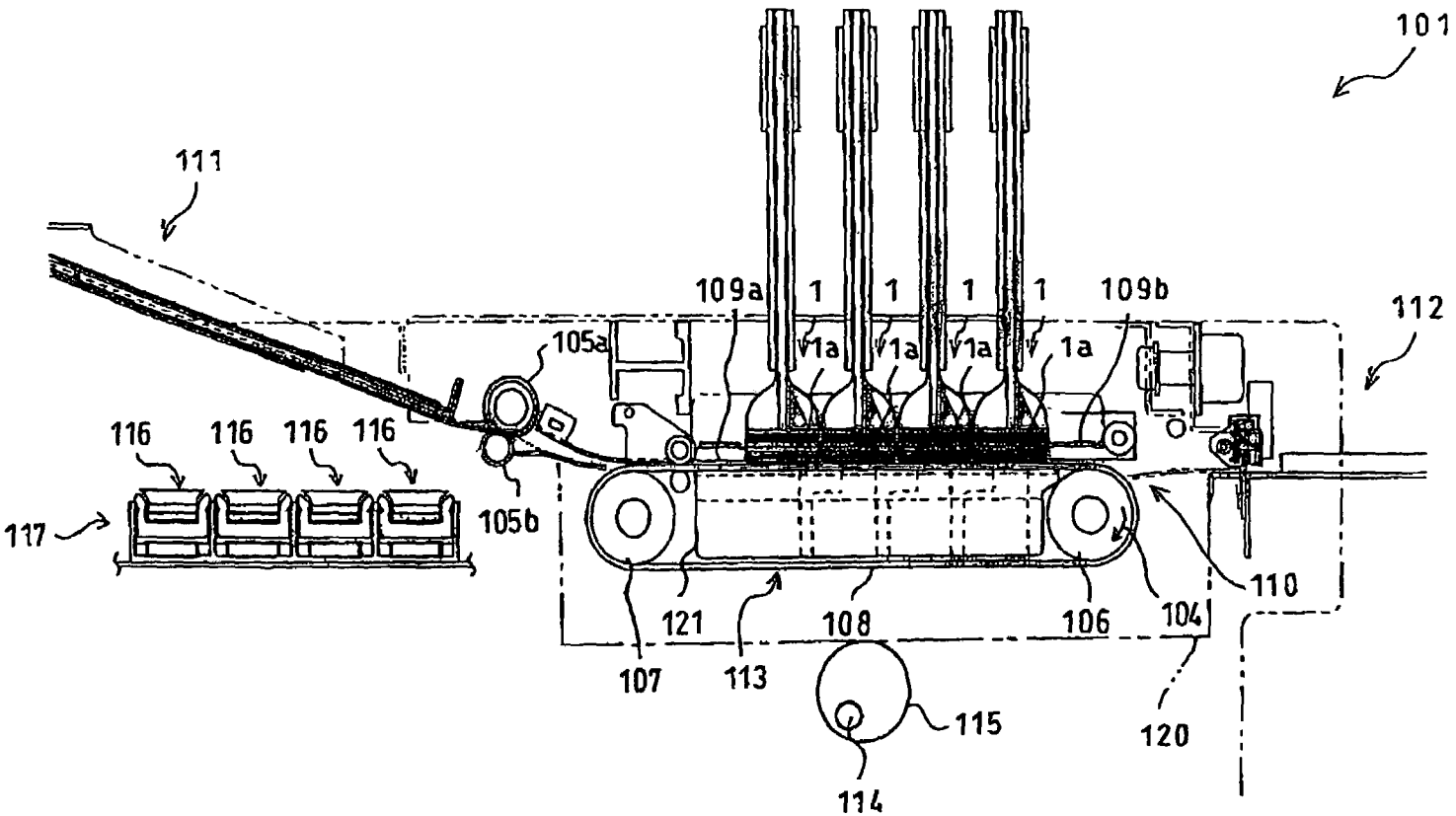
FIG. 1 illustrates a general construction of an ink-jet printer according to an embodiment of the present invention.

In the following, some preferred embodiments of the present invention will be described in conjunction with the accompanying drawings.

First, referring to FIG. 1, a description will be given to a general construction of an ink-jet printer according to an embodiment of the present invention. An ink-jet printer 101 of this embodiment is a color printer having four ink-jet heads 1. The printer 101 includes a paper feed unit 111 (as shown lefthand in FIG. 1) and a paper discharge unit 112 (as shown righthand in FIG. 1). Within the printer 1, formed is a paper conveyance path running from the paper feed unit 111 to the paper discharge unit 112.

A pair of paper feed rollers 105*a* and 105*b* are disposed immediately downstream from the paper feed unit 111, so that the rollers 105*a* and 105*b* can pinch a paper as a record medium which is in this condition conveyed from left to right in FIG. 1. In a middle of the paper conveyance path and below the four heads 1, a conveyance unit 113 is provided in confrontation with the four heads 1. The conveyance unit 113 has two rollers 106 and 107, and a looped conveyor belt 108 that is wound on the rollers 6 and 7 to be stretched between them.

The conveyor belt 108 has a two-layered structure made up of a silicone rubber and a polyester-base body impregnated with urethane. The silicone rubber is adopted to form an outer face, i.e., a conveyor face of the conveyor belt 108. A paper fed through the pair of paper feed rollers 105*a* and 105*b* is pressed on the conveyor face of the conveyor belt 108 to thereby be held onto the conveyor face by adhesive power, and in this condition conveyed downstream, i.e., rightward in FIG. 1 in association with clockwise rotation (rotation in a direction of the arrow 104) of one roller 106.

Pressing members 109*a* and 109*b* are provided at a position where a paper is fed onto the conveyor belt 108 and a position where a paper is discharged from the conveyor belt 108, respectively. The pressing members 109*a* and 109*b* serve to press a paper onto the conveyor face of the conveyor belt 108 in order to prevent a separation of the paper from the conveyor face. Thereby, the paper can surely be held on the conveyor face to be conveyed on.

A peeling plate 110 is provided immediately downstream (rightward in FIG. 1) from the conveyor belt 108. The peeling plate 110 peels off a paper, which is held on the conveyor face of the conveyor belt 108 by adhesive power, from the conveyor face so that the paper can be transferred toward the paper discharge unit 112.

The four ink-jet heads 1 are arranged in parallel along a paper conveyance direction, and each ink-jet head 1 has, at its lower end, a head main body 1*a*. Each head main body 1*a* has a rectangular shape when sectioned along a plane that is parallel to the conveyor face. The head main bodies 1*a* are arranged close to one another with a longitudinal axis of each head main body 1*a* extending perpendicularly to the paper conveyance direction, i.e., perpendicularly to the drawing sheet of FIG. 1. That is, the printer 101 is of line type. Bottom faces of the respective four head main bodies 1*a* confront the paper conveyance path, and a large number of small-diameter nozzles (not illustrated) are arranged on the bottom faces of the four head main bodies 1*a*. Ejected from the bottom faces of the four head main bodies 1*a* are magenta ink, yellow ink, cyan ink, and black ink, respectively.

Between the conveyor face of the conveyor belt 108 and the bottom faces of the head main bodies 1*a*, formed is a narrow clearance, though which the paper conveyance path is formed. With this construction, while a paper, which is being conveyed by the conveyor belt 108, passes immediately under the four head main bodies 1*a* in order, the respective color inks are ejected through the corresponding nozzles toward an upper face, i.e., a print face of the paper to thereby form a desired color image on the paper.

In a space enclosed by the conveyor belt 108, a nearly rectangular parallelepiped guide 121 is disposed to be opposed to the ink-jet heads 1. The guide 121 is in contact with an inner face of an upper-located part of the conveyor belt 108 to thereby support the upper-located part from an inside. The guide 121 and the conveyor belt 108 have substantially the same width.

The ink-jet printer 101 further comprises a maintenance unit 117 that performs maintenance on the ink-jet heads 1. The maintenance unit 117 includes four purge caps 116 that are adapted to cover the bottom faces of the respective head main bodies 1*a*.

While the ink-jet printer 101 is performing a printing operation, the maintenance unit 117 is in a "withdrawal position" which means a position immediately below the paper feed unit 111 as shown in FIG. 1. When a predetermined condition is satisfied after completion of the printing operation, the maintenance unit 117 moves in a horizontal direction into a "maintenance position" which means a position immediately below the four head main bodies 1*a*, that is, a position where the conveyance unit 113 exists in FIG. 1. Examples of the aforesaid predetermined condition include a condition that the printer 101 remains without any printing operation for a predetermined time period, a condition that the printer 101 is powered off, and the like. When the maintenance unit 117 is in the maintenance position, the purge caps 116 of the maintenance unit 117 cover the bottom faces of the corresponding head main bodies 1*a* in order to avoid drying of the nozzles.

The conveyance unit 113 is supported on an elevator mechanism including a chassis 120, and movable in a vertical direction by means of the elevator mechanism. The chassis 120, which is a component of the elevator mechanism, is put on a cylindrical member 115 disposed thereunder. The cylindrical member 115 is rotatable around a shaft 114 that is deviated from a center of the cylindrical member 115. Thus, in association with rotation of the shaft 114, an uppermost level of the cylindrical member 115 varies, and accordingly the chassis 120 and the conveyance unit 113 move up and down.

Before the maintenance unit 117 starts moving from the "withdrawal position" into the "maintenance position", the cylindrical member 115 is rotated through an appropriate angle so that the conveyance unit 113 as well as the chassis 120 are moved down to a good extent from the position as it is in FIG. 1. As a result, there appears a space though which the maintenance unit 117 moves.

Next, referring to FIGS. 2, 3, and 4, a description will be given to a system for supplying ink to the ink-jet heads 1 illustrated in FIG. 1.

Figure 3:
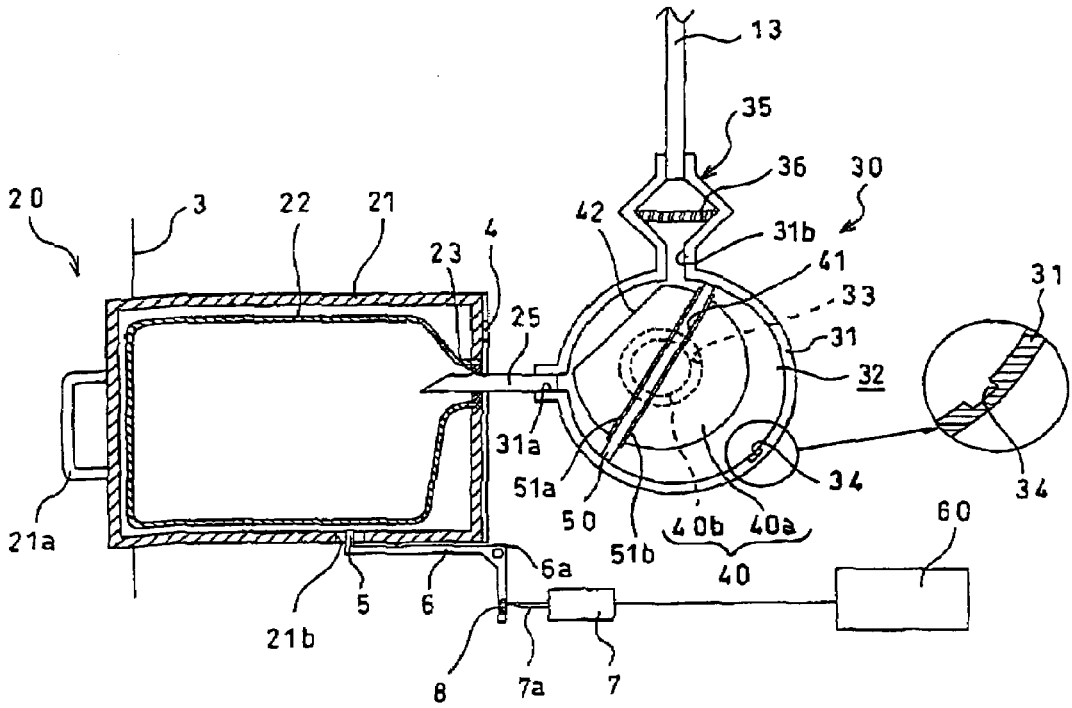
FIG. 3 is a partial sectional view of a pump and an ink cartridge illustrated in FIG. 2.

The printer 101 includes therein four receivers 3 (only one of which is shown in FIG. 3) that receive ink cartridges 20 in a detachable manner. Each receiver 3 receives one ink cartridge 20, and the four ink cartridges 20 received in the respective receivers 3 contain different colors of ink from one another. The ink cartridges 20 are mounted to the corresponding receivers 3 in a direction of left to right in FIG. 3. With respect to a direction along which the ink cartridge 20 is mounted, a downstream side (i.e., a right side in FIG. 3) is hereinafter referred to as a "front" side, and an upstream side (i.e., a left side in FIG. 3) is hereinafter referred to as a "rear" side.

As illustrated in FIG. 3, a switch 4 of push-button type is provided in a face of the receiver 3 confronting a front face of the ink cartridge 20. Upon a contact with the front face of the ink cartridge 20, the switch 4 sends a mounting-completion signal to a CPU (i.e., Central Processing Unit) 61 of a controller 60 (see FIG. 5). The mounting-completion signal means a signal informing that an ink cartridge 20 is completely received in a receiver 3.

The receiver 3 further includes, in its lower right side in FIG. 3, a stopper 5, an L-shaped arm 6 having a right-angled portion 6*a*, and a solenoid valve 7. One end of the L-shaped arm 6 is connected with the stopper 5, and the other end thereof is connected with the solenoid valve 7. The stopper 5 is insertable into an opening 21*b* that is formed in a casing 21 of the ink cartridge as will be described later. The arm 6 has an elongated slot 8 formed through its one end portion near the solenoid valve 7. Within the elongated slot 8, attached is one end of a slide-movable portion 7*a* of the solenoid valve 7. The right-angled portion 6*a* of the arm 6 is supported on a main frame of the printer 101 so that the arm 6 may rotate therearound.

When the slide-movable portion 7*a* of the solenoid valve 7, which is in a state shown in FIG. 3, slides toward an inside of the solenoid valve 7 (i.e., slides rightward in FIG. 3), the arm 6 rotates around the right-angled portion 6*a* in a counterclockwise direction in FIG. 3, so that the stopper 5 is pulled out of the opening 21*b* and at the same time the one end of the slide-movable portion 7*a* moves along the elongated slot 8. In order to renew the ink cartridge 20, the stopper 5 is pulled out of the opening 21*b* in this manner to thereby allow the ink cartridge 20 to be detached from and attached to the receiver 3. Then, after completion of mounting of the ink cartridge 20, the stopper 5 is inserted into the opening 21*b*. Thereby, the ink cartridge 20 can be duly locked against improper dismounting from the receiver 3.

Figure 2:
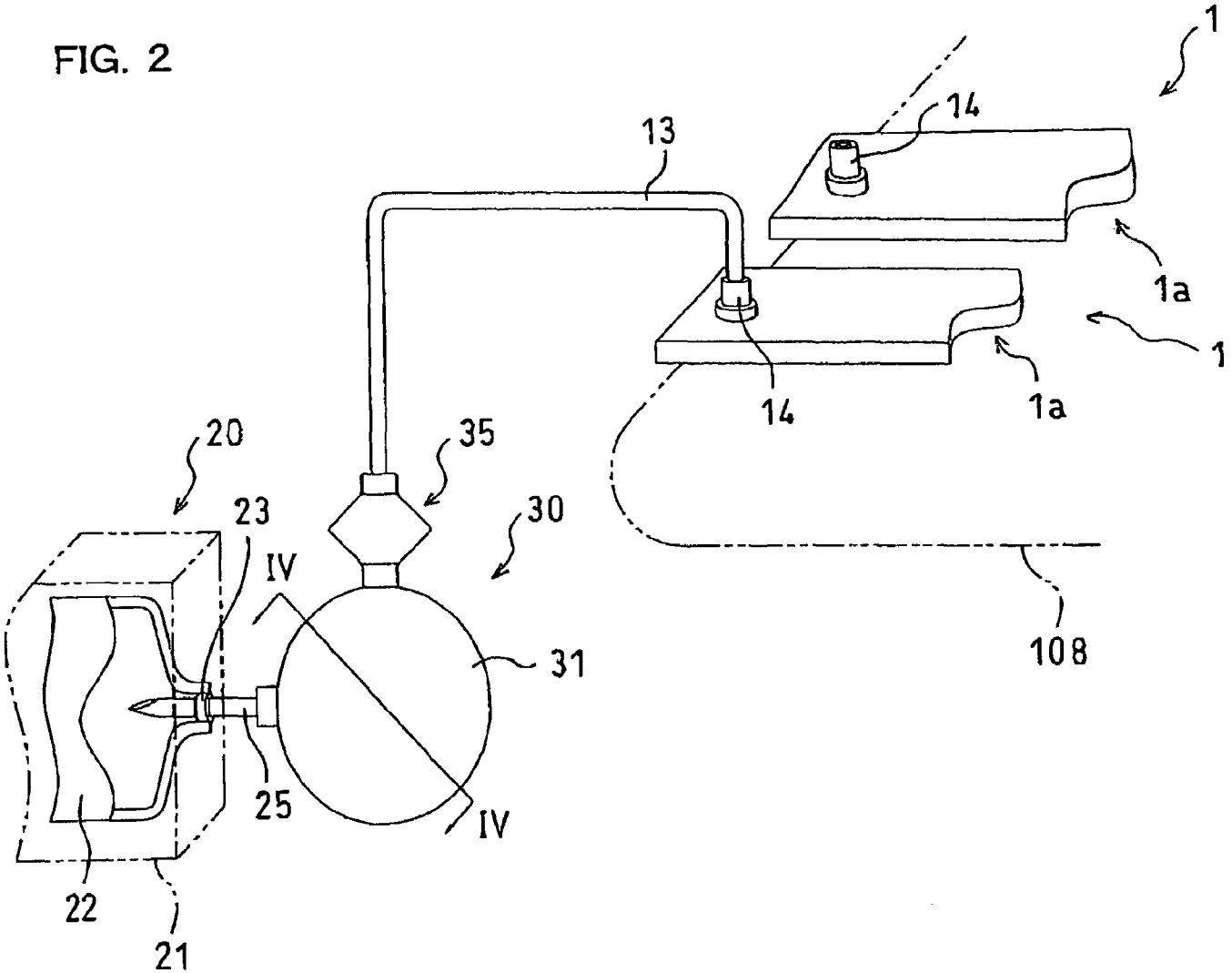
FIG. 2 schematically illustrates a system for supplying ink to an ink-jet head illustrated in FIG. 1.

As illustrated in FIG. 2, each ink cartridge 20 and each corresponding ink-jet head 1 are connected with each other through a pump 30 and a long cylindrical tube 13. The tube 13 is made of an elastomer and has a sufficient flexibility. On an upper face of each head main body 1*a*, provided is a tube-shaped member 14 that protrudes from the vicinity of one longitudinal end of the upper face. One end of the tube 13 is fitted into the tube-shaped member 14, and the other end thereof is connected with the pump 30. Ink is introduced from the ink cartridge 20, through the pump 30, the tube 13, and the tube-shaped member 14, into an ink passage formed within the head main body 1*a*, and the ink is then ejected through the nozzles.

As illustrated in FIGS. 2 and 3, the ink cartridge 20 includes a casing 21 made of a synthetic resin, and an ink bag 22 disposed within the casing 21.

Referring to FIG. 3, a handle 21*a* is provided on a rear face of the casing 21. The opening 21*b* into which the stopper 5 can be inserted is formed through a bottom wall of the casing 21 in its thickness direction.

The ink bag 22 is made of a pouch film that has been obtained by thermocompression-bonding a plurality of flexible films. The ink bag 22 contains deaerated ink. The pouch film has a layered structure made up of, from inside to outside, an innermost polypropylene layer, a polyester layer as a base material, an aluminum-foil layer having a gas barrier function, and a nylon layer for improving strength. A cap 23 made of a silicone rubber or a butyl rubber seals an opening of the ink bag 22.

A cylindrical hollow needle 25 made of a metal protrudes from the pump 30, and is pierced through the cap 23. In order to renew the ink cartridge 20, the hollow needle 25 is pulled away from the cap 23 so that the ink cartridge 20 can be separated from the pump 30.

The pump 30 includes a housing 31 in which a substantially cylindrical cavity 32 is formed. The housing 31 has a cylindrical shape with its axis extending in a direction perpendicular to the drawing sheets of FIGS. 2 and 3, that is, extending in a lateral direction of the drawing sheet of FIG. 4. The housing 31 has, on its peripheral wall, an inlet port 31*a* (shown on a left side in FIG. 3) through which ink is sucked into the cavity 32, and an outlet port 31*b* (shown on an upper side in FIG. 3) through which ink is discharged out of the cavity 32. Both the inlet port 31*a* and the outlet port 31*b* are defined by walls that protrude from the peripheral wall of the housing 31.

A base end of the hollow needle 25 is fitted into the inlet port 31*a*. A front end of the hollow needle 25 has an obliquely cut, sharpened shape, and is pierced through the cap 23 of the ink cartridge 20. Ink contained in the ink bag 22 of the ink cartridge 20 flows through the hollow needle 25, and then introduced from the inlet port 31*a* into the cavity 32 of the pump 30.

A recess 34 is formed in an inner surface of the peripheral wall of the housing 31 (and, in FIG. 3, formed at a lower-right portion of the inner face). The recess 34 is positioned substantially in the middle of a length of the housing 31 in its axial direction (i.e., in the horizontal direction in FIG. 4). A length of the recess 34 in the aforesaid axial direction is approximately one third of a length of the peripheral wall of the housing 31 in the same axial direction.

The housing 31 includes therein a rotor 40. An opening 33 for a shaft 40*b* of the rotor 40 passing therethrough is provided in one endwall of the housing 31 whose plane is perpendicular to the axial direction. The rotor 40 includes a rotator 40*a* rotatable within the cavity 32, and a shaft 40*b* that transmits rotation force to the rotator 40*a*.

The rotator 40*a* has a substantially cylindrical shape whose peripheral surface is partially flattened to thereby form a cut-off portion 42. The rotator 40*a* is rotatable around an axis that extends in the direction perpendicular to the drawing sheets of FIGS. 2 and 3, that is, extends in the lateral direction of the drawing sheet of FIG. 4. A thickness of the rotator 40*a* in the axial direction is substantially equal to a distance between opposite endwalls of the housing 31. Thus, endwalls of the rotator 40*a*, whose planes are perpendicular to the axial direction, are in contact with the housing 31 (see FIG. 4). The shaft 40*b* has a substantially cylindrical shape with its diameter smaller than that of the rotator 40*a*. The shaft 40*b* protrudes, in the axial direction, from a center of one endwall of the rotator 40*a* whose plane is perpendicular to the axial direction. The shaft 40*b* is eccentric to an axial center of the housing 31. During rotation of the rotator 40*a*, the peripheral surface of the rotator 40*a* except the cut-off portion 42 is partially contactable with the inner surface of the housing.

The rotator 40*a* also has a slit 41 that extends in a diametrical direction without overlapping the cut-off portion 42. The slit 41 is formed throughout an entire thickness of the rotator 40*a*. In the slit 41, disposed are a partition 50, and two slide members 51*a* and 51*b* that sandwich the partition 50 therebetween. The partition 50 and the slide members 51*a* and 51*b* are supported on the rotator 40*a* such that their end portions in the diametrical direction can confront the inner surface of the housing 31. In this condition, the partition 50 and the slide members 51*a* and 51*b* are, together with the rotator 40*a*, rotatable within the cavity 32.

There is a very narrow clearance between each slide member 51*a* or 51*b* and a face of the rotator 40*a* defining the slit 41. The partition 50 and the slide members 51*a* and 51*b* are put in layers as illustrated in FIG. 3, and, in this condition, are slidable in the slit in the diametrical direction of the rotator 40*a*. In addition, the partition 50 and the slide members 51*a*, 51*b* are made from different materials as will be detailed later. As a result, the slide members 51*a* and 51*b* obtain a smaller sliding friction coefficient against an inner surface of the slit 41 than that of the partition 50. Thus, the partition 50 and the slide members 51*a* and 51*b* are, while kept in the layered state, slidable smoothly within the slit 41.

Each of the partition 50 and the slide members 51*a* and 51*b* is a plate-like member having a rectangular shape in a plan view whose length in the diametrical direction of the rotator 40 is larger than that of the rotator 40. However, the partition 50 and the slide members 51*a*, 51*b* are different from each other in their length in the diametrical direction, thickness, materials, and the like. A length of the partition 50 in the diametrical direction, which is longer than that of the slide members 51*a* and 51*b*, is substantially equal to a diameter of the cavity 32. In addition, the partition 50 is thicker than the slide members 51*a* and 51*b*. The partition 50 is made of an elastic material such as EPDM (i.e., ethylene-propylene-diene terpolymer) based synthetic rubbers, whereas the slide member 51*a* and 51*b* are made of a POM (i.e., polyoxymethylene) resin or the like.

The length of the slide members 51*a* and 51*b* in the diametrical direction is smaller than that of the partition 50. Therefore, when the slide members 51*a* and 51*b* rotate with the rotator 40*a*, their both ends in the diametrical direction are not brought into contact with the inner surface of the housing 31.

Without the slide members 51*a* and 51*b*, a portion of the partition 50 protruding from the rotator 40*a* would be bent so much due to its friction against the inner surface of the housing 31 during rotation of the rotator 40*a*, and therefore excessive rotational torque would often be caused. In this embodiment, however, such a bending and excessive rotational torque can be prevented because the portion of the partition 50 protruding from the rotator 40*a* is sandwiched between the slide members 51*a* and 51*b*.

Figure 4:
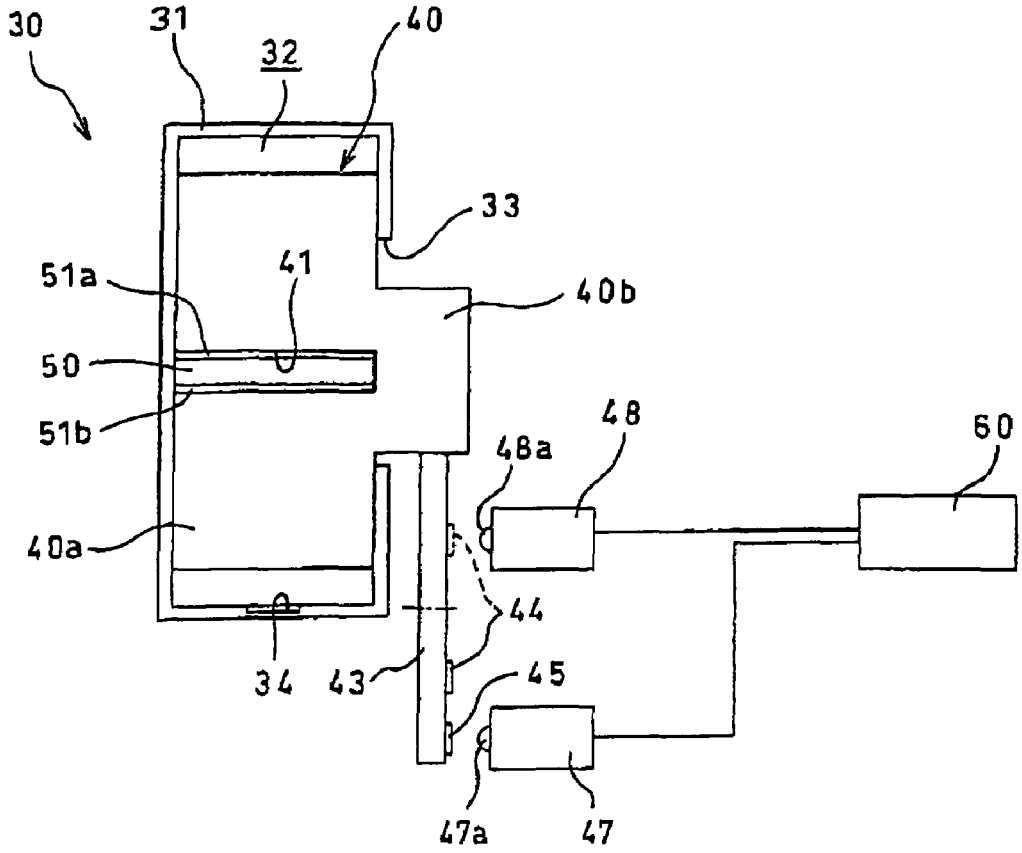
FIG. 4 is a sectional view of the pump taken along the line IV-IV of FIG. 2.

The rotor 40 rotates in association with rotation of a gear 43 that is disposed to be always kept in contact with a part of a peripheral surface of the shaft 40*b* as illustrated in FIG. 4. Two protrusions 44 and 45 are formed on a surface of the gear 43 opposite to a surface thereof facing the housing 31. The two protrusions 44 and 45 are provided side by side to form a line along a diameter of the gear 43, and are displaced along with rotation of the gear 43.

Two proximity sensors 47 and 48 are respectively disposed at a position confronting the protrusion 45 (illustrated with a solid line in FIG. 4) as located when the rotor 40 is in a later-described "print position" and at a position confronting the protrusion 44 (illustrated with a dotted line in FIG. 4) as located when the rotor 40 is in a later-described "introduction position". The proximity sensors 47 and 48 include detectors 47*a* and 48*a*, respectively. When the protrusions 44 and 45 are brought into confrontation with the corresponding detectors 48*a* and 47*a*, the sensors 47 and 48 detect them. A rotational state of the rotor 40, which includes a position of the partition 50, can be determined based on results of detections by the proximity sensors 47 and 48.

The pump 30 further includes a filter container 35 that is connected to the housing 31 through the outlet port 31*b*. Inside the filter container 35, formed is a cavity that is most expanded outward around its center in a vertical direction. The filter container 35 opens out at upside and downside thereof. A lower opening of the filter container 35 corresponds to the outlet port 31*b*, and the other side of the tube 13 is fitted into an upper opening thereof. Thus, a vertical ink passage extending from the outlet port 31*b* to the tube 13 is formed inside the filter container 35.

A mesh filter 36 is disposed substantially at the center of the cavity within the filter container 35. The mesh filter 36 can filtrate ink on the way to be supplied from the ink cartridge 20 into the ink-jet head 1. Even if, for example, rubber chips, etc., are produced by insertion/unisertion of the hollow needle 35 into/from the cap 23, such rubber chips can be captured by the filter 36 and thus removed from ink. The provision of the filter container 35 enables simplification of the ink cartridge 20, because it is not necessary to provide an extra filter within the ink cartridge 20.

The filter 36 is laid in a horizontal manner. Accordingly, even if air bubbles are produced in the cavity 32 at the time of introducing ink into the empty cavity 32 of the pump 30 (i.e., at the time of initial ink introduction) or the like, the air bubbles can easily be discharged through the filter 36 because the air bubbles receive a relatively large force that travels upward in the vertical direction. Such a relatively large force is produced by a combination of buoyancy of the air bubbles and liquid-feeding force of the pump 30. This can prevent stay of a large amount of air bubbles on an upstream side of the filter 36 (i.e., under the filter 36 in FIG. 3), and therefore can prevent an interruption of ink supply to the ink-jet head 1.

In addition, the outlet port 31*b* is formed in an upper face of the housing 31. Therefore, even if air bubbles arise within the cavity 32, the air bubbles follow the buoyancy to move upward in the vertical direction and then are smoothly discharged through the filter 36.

Next, referring to FIG. 5, an electrical structure in the ink-jet printer 101 will be described.

A controller 60 in the ink-jet printer 101 includes a CPU 61, an interface 62, an ROM 63, an RAM 64, an input port 65, and an output port 66. Upon a print instruction signal that has been inputted through the interface 62, the CPU 61 operates in accordance with a control program stored in the ROM 63. In this manner, a printing operation including feeding a paper, conveying a paper, discharging a paper, and ejecting ink, etc., are controlled.

The CPU 61 performs, if necessary, various processings using the RAM 64. The CPU 61 also receives printing data from the outside (e.g., from a personal computer) via the interface 62, then, if necessary, prepares print image data using image data or the like that are stored in the ROM 63, and then stores the print image data in the RAM 64.

The CPU 61 drives, via the output port 66 and a motor driver 131, a paper feed motor 141 that is connected with the paper feed rollers 105*a* and 105*b* (see FIG. 1). The CPU 61 also drives, via the output port 66 and a motor driver 132, a conveyor motor 142 that is connected with the roller 106. In addition, the CPU 61 drives each of the four ink-jet heads 1 via a head drive circuit 130, thereby printing an image based on print image data.

Next, referring to FIGS. 6A, 6B and 6C, a description will be given to a process of mounting the ink cartridge 20 to the receiver 3.

Figure 6A:
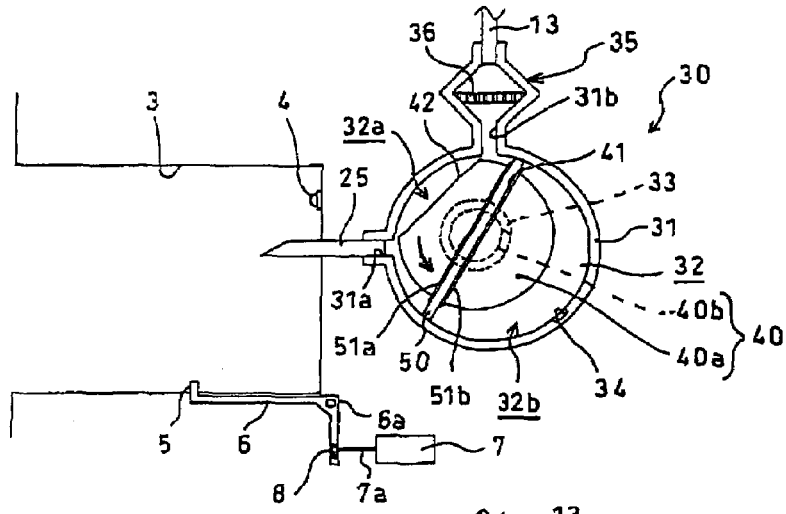
FIGS. 6A, 6B, and 6C are partial sectional stepwise views showing a process of mounting the ink cartridge to a receiver.

FIG. 6A shows a state where the ink cartridge 20 is not yet mounted to the receiver 3. At this time, no ink is contained in the cavity 32 of the pump 30.

When the printer 101 is powered up, the CPU 61 (see FIG. 5) determines that "ink should be initially introduced into the cavity 32 of the pump 30", and then drives a rotor drive motor 143 via the output port 66 and a motor driver 133, thereby rotating the gear 43 illustrated in FIG. 4. Thus, the rotor 40 starts rotating in the counterclockwise direction in FIG. 6A.

After the CPU 61 determines that "ink should be initially introduced into the cavity 32 of the pump 30", the proximity sensor 48 starts its detection operation. The rotor 40 comes in an introduction position as shown in FIG. 6B, and, coincidently with this, the proximity sensor 48 detects the protrusion 44 (see FIG. 4) and then sends a detection signal to the CPU 61 via the input port 65. The CPU 61, which has received the detection signal, stops the rotor drive motor 143 via the output port 66 and the motor driver 133, and then the gear 43 is stopped accordingly.

Figure 6B:
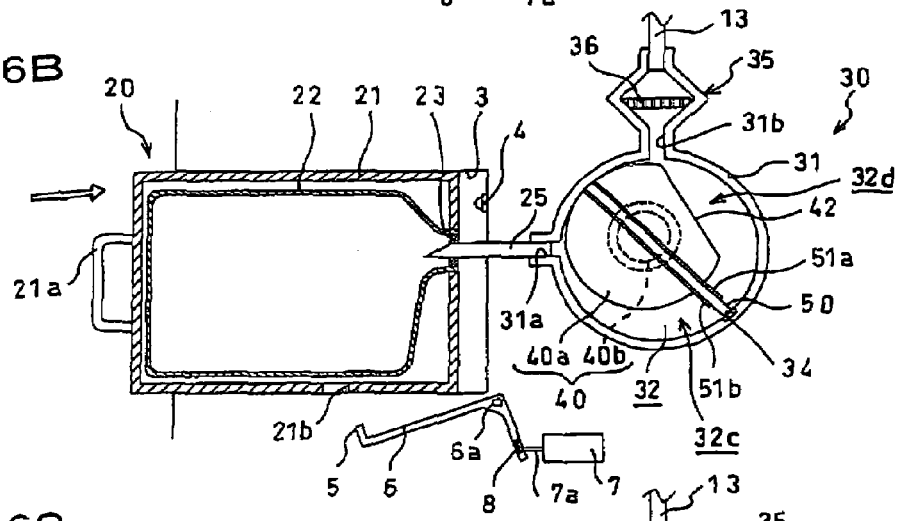
Figure 6C:
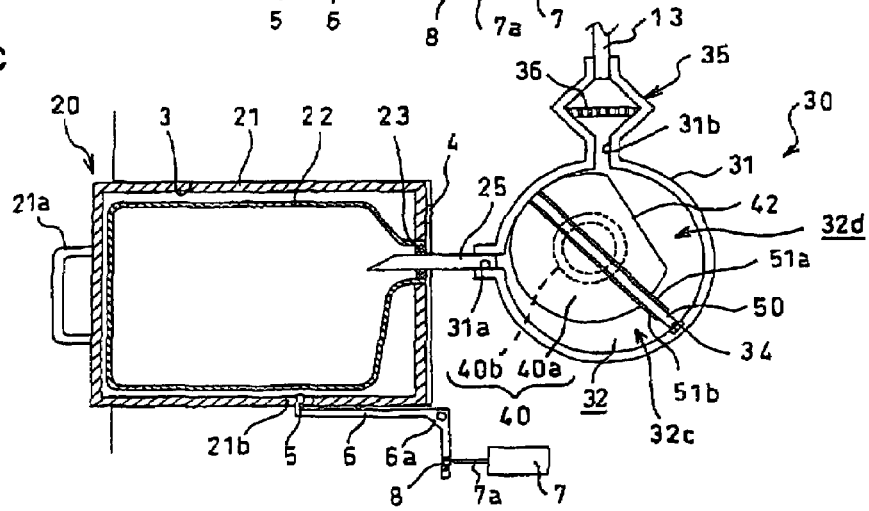

The CPU 61 thus stops the rotor drive motor 143, and at the same time drives the solenoid valve 7 via the output port 66 and a solenoid valve driver 134 so that the slide-movable portion 7*a* can slide toward the inside of the solenoid valve 7 (i.e., slide rightward in FIG. 6B). As a result, the arm 6 rotates around the right-angled portion 6*a* in the counterclockwise direction in FIG. 6B, and the stopper 5 is pulled out of the receiver 3. Thus, the ink cartridge can be mounted to the receiver 3. In this state, a user grips the handle 21*a*, and moves the ink cartridge 20 rightward in FIG. 6B to thereby mount the ink cartridge 20 to the receiver 3.

Coincidently with completion of mounting the ink cartridge 20 to the receiver 3, the front face of the ink cartridge 20 comes into contact with the switch 4, which then sends a mounting-completion signal to the CPU 61 via the input port 65. The CPU 61, which has received the mounting-completion signal, drives the solenoid valve 7 via the output port 66 and the solenoid valve driver 134, so that the slide-movable portion 7*a* can slide outward from the solenoid valve 7 (i.e., slide leftward in FIG. 6B). Consequently, the arm 6 rotates around the right-angled portion 6*a* in a clockwise direction in FIG. 6B, and the stopper 5 is inserted into the opening 21. Thereby, the ink cartridge 20 can be duly locked against improper dismounting from the receiver 3 (see FIG. 6C).

Thereafter, a pressing mechanism (not illustrated) provided in the ink cartridge 20 presses the ink bag 22, so that ink contained in the ink bag 22 flows through the hollow needle 25 and then introduced from the inlet port 31*a* into the cavity 32 of the pump 30. How the ink flows within the cavity 32 at this time will be detailed later.

How long a time period the rotor drive motor 143 is stopped during the initial ink introduction is determined in the following manner.

Figure 5:
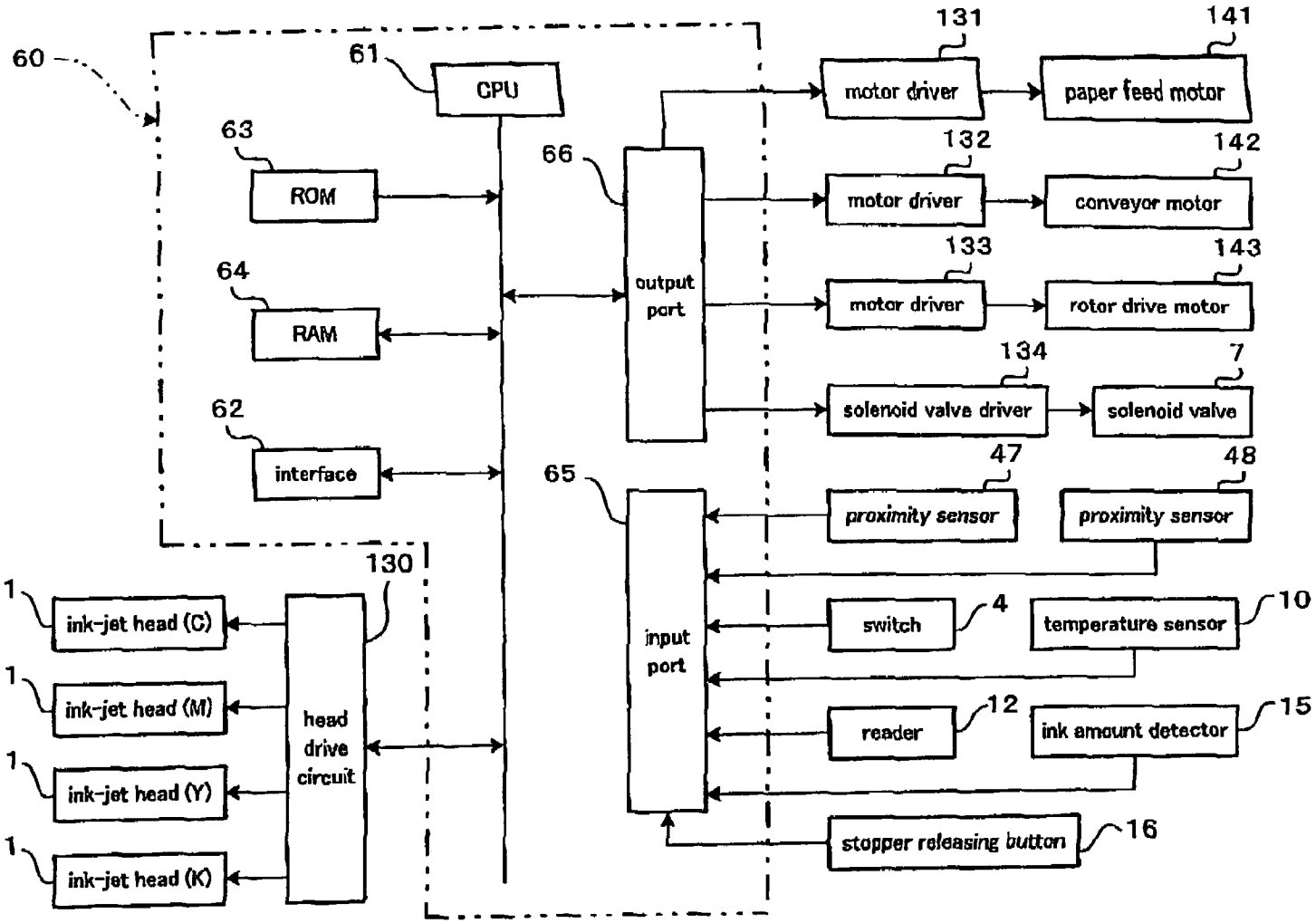
FIG. 5 is a block diagram showing an electrical structure in the ink-jet printer illustrated in FIG. 1.

Each ink cartridge 20 has a chip (not illustrated) that stores therein ink information, and each receiver 3 has a reader 12 (see FIG. 5). When the ink cartridge 20 is completely mounted to the receiver 3, the reader 12 reads the ink information stored in the chip and sends that information to the CPU 61 via the input port 65.

The printer 101 includes a temperature sensor 10 (see FIG. 5) that measures an ambient temperature in the printer 101.

The temperature sensor 10 sends a temperature information to the CPU 61 via the input port 65.

Based on the ink information and the temperature information respectively sent from the reader 12 and the temperature sensor 10, the CPU 61 retrieves data from the ROM 63 or RAM 64, to thereby determine how long a time period the rotor drive motor 143 should be stopped.

For example, when the ink cartridge 20 contains ink having a high viscosity, it takes a relatively long time to fill the cavity 32 with the ink. If the rotor 40 rotates before the cavity 32 is filled with the ink, the ink incurs air bubbles because the ink is mixed with air that has already existed in the cavity 32 prior to the ink introduction. In this embodiment, therefore, a viscosity of ink is identified based on the ink information and the temperature information, and a suitable time period for ink introduction is calculated in accordance with the viscosity of ink, then determining how long a time period the rotor drive motor 143 should be stopped in order to keep the rotor 40 stopped until the cavity 32 is filled with ink. That is, the rotor drive motor 143 is stopped until air existing in the cavity 32 is moved by ink toward the outlet port 31*b* so that the cavity 32 is filled with ink. As a result, air bubbles are unlikely to arise within the cavity 32.

Figure 7A:
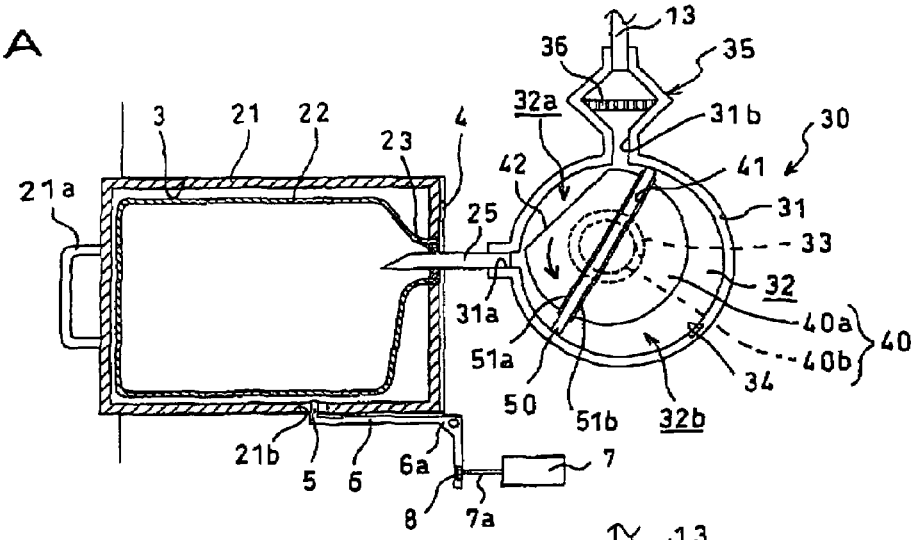
FIGS. 7A, 7B, and 7C are partial sectional stepwise views showing a process of dismounting the ink cartridge from the receiver.

After completion of the initial ink introduction into the cavity 32, a print start signal is sent to the CPU 61. The CPU 61, which has received the print start signal, drives the rotor drive motor 143 to rotate the rotor 40. Then, the rotor 40 comes into a print position as shown in FIG. 7A, and, coincidently with this, the proximity sensor 47 detects the protrusion 45 (see FIG. 4) and sends a detection signal to the CPU 61 via the input port 65. The CPU 61, which has received the detection signal, stops the rotor drive motor 143 via the output port 66 and the motor driver 133. The ink-jet heads 1 then perform a printing operation with the rotor 40 being kept in the print position as shown in FIG. 7A. At this time, each ink-jet head 1 sucks ink from the corresponding ink cartridge 20 by making use of a capillary effect within the nozzles of the head main body 1*a* and a difference between the ink cartridge 20 and the nozzles in pressure acting thereon.

Next, referring to FIGS. 7A, 7B, and 7C, a description will be given to a process of dismounting the ink cartridge 20 from the receiver 3.

FIG. 7A shows a state where the ink-jet head 1 is performing a printing operation. At this time, the ink cartridge 20 is completely mounted to the receiver 3.

When an ink amount detector 15 (see FIG. 5), which is provided in the ink cartridge 20, sends to the CPU 61 a signal that ink contained in the ink bag 22 runs out, the CPU 61 determines that "the ink cartridge should be renewed". The CPU 61 then drives the rotor drive motor 143 to rotate the rotor 40 in the counterclockwise direction in FIG. 7A.

After the CPU 61 determines that "the ink cartridge should be renewed", the proximity sensors 47 and 48 start their detection operations. The CPU 61 determines a rotational state of the rotor 40 on the basis of results of detection by the proximity sensors 47 and 48. The rotor 40 comes in a dismount position as shown in FIG. 7B, and, coincidently with this, the CPU 61 stops the rotor drive motor 143, and then the gear 43 is stopped accordingly.

Figure 7B:
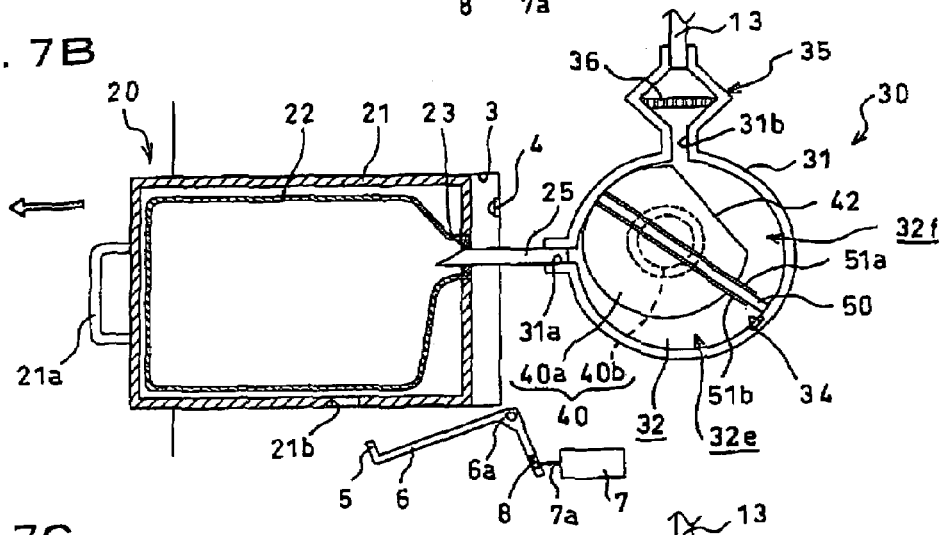
Figure 7C:
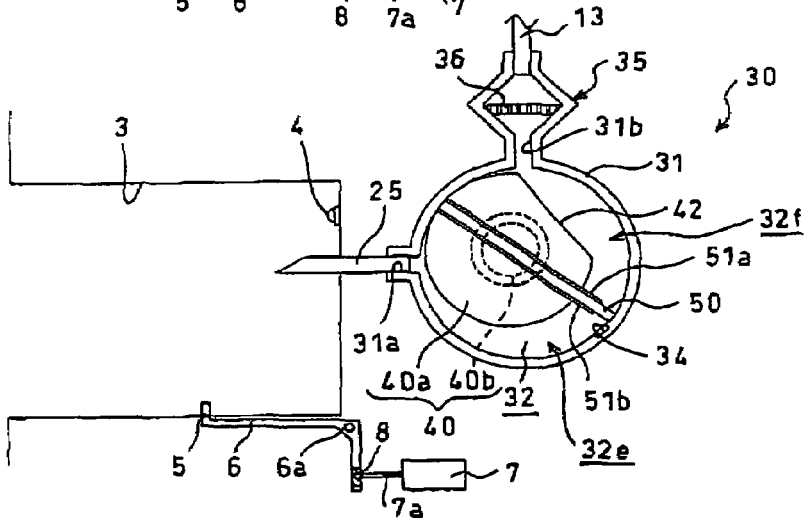

The CPU 61 thus stops the rotor drive motor 143, and at the same time drives the solenoid valve 7 via the solenoid valve driver 134 so that the slide-movable portion 7*a* can slide toward the inside of the solenoid valve 7 (i.e., slide rightward in FIG. 7B). As a result, the arm 6 rotates around the right-angled portion 6*a* in the counterclockwise direction in FIG. 7B, and the stopper 5 is pulled out of the opening 21*b*. Thus, the ink cartridge becomes dismountable from the receiver 3. In this state, a user grips the handle 21*a*, and moves the ink cartridge 20 leftward in FIG. 7B to thereby dismount the ink cartridge 20 from the receiver 3.

When the front face of the ink cartridge 20 becomes apart from the switch 4, the switch 4 sends a signal to the CPU 61 via the input port 65. The CPU 61, which has received the signal, drives the solenoid valve 7 via the output port 66 and the solenoid valve driver 134, so that the slide-movable portion 7*a* can slide outward from the solenoid valve 7 to insert the stopper 5 into the receiver 3 (see FIG. 7C).

Even when ink remains within the ink cartridge 20, the ink cartridge 20 can be renewed by pushing a stopper releasing button 16 (see FIG. 5) that is provided in the printer 101. The CPU 61 receives a signal from the stopper releasing button 16 via the input port 65, and then performs the same operations as when it receives the signal from the ink amount detector 15. As a result, the ink cartridge 20 becomes dismountable from the receiver 3.

Next, referring to FIGS. 8A, 8B, and 8C, a description will be given to a state of the pump during a purge operation. A purge operation is performed after, e.g., a renewal of the ink cartridge 20, and allows ink containing air bubbles to be discharged, through the nozzles, out of the tube 13 or the ink passage of the head main body 1*a*. The ink having thus discharged is received in the purge caps 116 (see FIG. 1), and stored in a waste ink tank (not illustrated) that is connected with the purge caps 116.

Figure 8C:
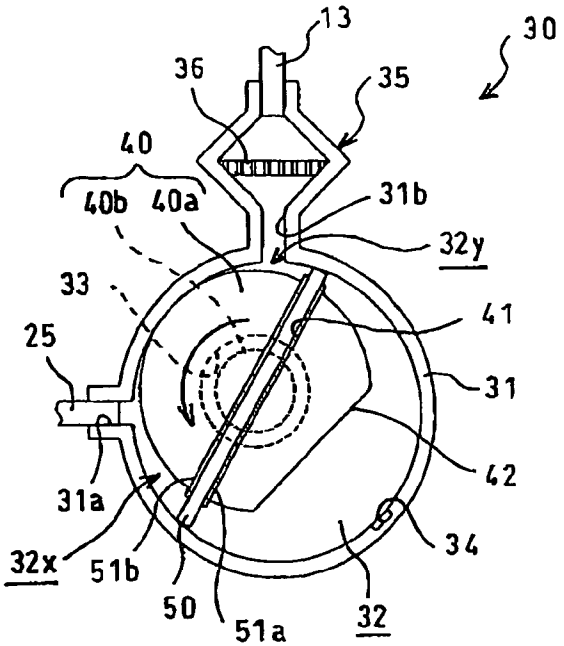
FIGS. 8A, 8B, and 8C are sectional views showing stepwise states of the pump during a purge operation.
Figure 8B:
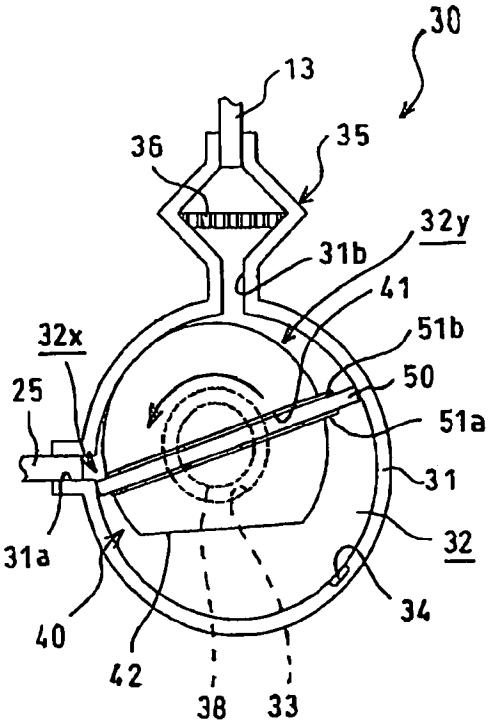
Figure 8A:
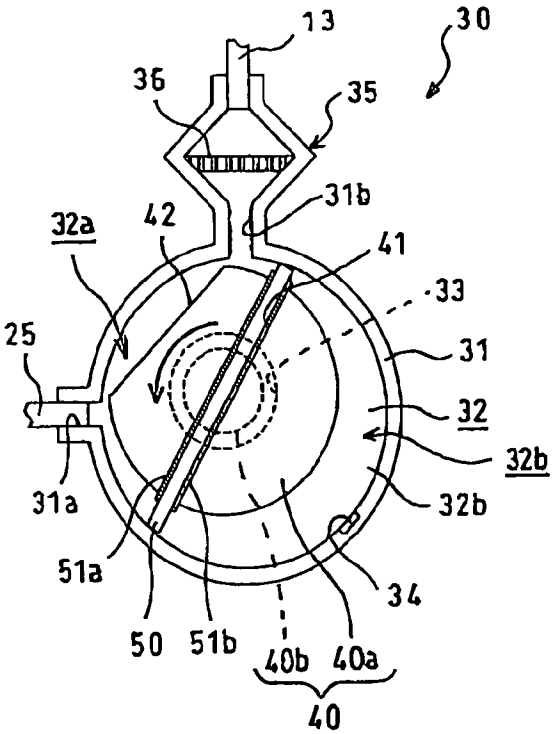

When the CPU 61 determines that "a purge operation should be performed", the CPU 61 drives the rotor drive motor 143 so that the rotor 40, which is in a state as shown in FIG. 8A, can rotate at a predetermined speed in the counterclockwise direction in FIG. 8A. As a result, since ink is forcibly supplied from the ink cartridge 20 to the head 1, ink staying within the tube 13 and within the ink passage of the head main body 1*a* is discharged through the nozzles.

Rotation of the rotor 40 changes positions of the cut-off portion 42 and the partition 50 relative positions to the housing 31, and flow resistance of ink within the cavity 32 is variously changed accordingly. When the peripheral surface of the rotator 40*a* and the inner surface of the housing 31, which have been spaced from each other by the cut-off portion 42 as illustrated in FIG. 8A, are brought into contact with each other as illustrated in FIG. 8B, a higher flow resistance is applied to ink that flows from the inlet port 31*a* through an upper-left side of the rotator 40*a* in FIG. 8B to the outlet port 31*b*. During a shift from a state of FIG. 8B to a state of FIG. 8C, a region 32*x* in which the inlet port 31*a* exists is gradually increased and negative pressure arises within the region 32*x*, so that ink is sucked from the ink cartridge 20 through the inlet port 31*a*. During a shift from the state of FIG. 8B to the state of FIG. 8C, a region 32*y* in which the outlet port 31*b* exists is gradually decreased. Accordingly, ink contained in this region 32*y* is forcibly supplied to the head 1 through the outlet port 31*b*.

FIG. 8B and FIG. 8C differ in position of the set of partition 50 and slide members 51*a* and 51*b* relative to the rotor 40. This is because, during the shift from the state of FIG. 8B to the state of FIG. 8C, pushing force applied by the inner surface of the housing 31 to one end of the partition 50 (as located on an upper-right side in FIG. 8B) gradually becomes larger than pushing force applied by the inner surface of the housing 31 to the other end of the partition 50 (as located on a lower side in FIG. 8B), and consequently the partition 50 slides together with the slide members 51*a* and 51*b*. Like this, in association with the rotation of the rotor 40, the partition 50 and the slide members 51*a* and 51*b* accordingly slide within the slit 41.

The partition 50 made of an elastic material as described above is, during its rotation with the rotor 40, expanded or contracted in the diametrical direction of the rotator 40*a* while having opposite ends thereof being always kept in contact with the inner surface of the housing 31 except the recess 34.

Next, referring to FIG. 9A, a description will be given to how ink flows within the cavity 32 of the pump 30 at the initial ink introduction into the cavity 32 of the pump 30. Prior to starting an initial ink introduction, the rotor 40 is moved into the introduction position as shown in FIGS. 6B and 6C. During the initial ink introduction, the rotor 40 is kept in the introduction position. At this time, the partition 50 partitions the cavity 32 into a region 32*c* in which the inlet port 31*a* exists and a region 32*d* in which the outlet port 31*b* exists. The cut-off portion 42 is located in the region 32*d* in which the outlet port 31*b* exists, and the peripheral surface of the rotator 40*a* is in contact with the inner surface of the housing 31. One end of the partition 50 is disposed in this contact area, and the other end thereof confronts the recess 34.

Passages extending from the inlet port 31*a* to the outlet port 31*b* are formed within the cavity 32. These passages include a first passage 30*a* and a second passage 30*b*. The first passage 30*a* runs on an upper-left side of the rotator 40*a* in FIG. 9A. The second passage 30*b* runs on a side of the rotator 40*a* opposite to the first passage 30*a*. The second passage 30*b* is longer than the first passage 30*a*.

When the rotor 40 is in the introduction position, a flow resistance in the first passage 30*a* is very high because the peripheral surface of the rotator 40*a* and one end of the partition 50 are in contact with the inner surface of the housing 31. In the second passage 30*b*, on the other hand, ink can flow relatively smoothly from the region 32*c* via the recess 34 into the region 32*d*, because the other end of the partition 50 confronts the recess 34. At this time, therefore, the flow resistance in the first passage 30*a* is higher than the flow resistance in the second passage 30*b*.

Ink having introduced from the inlet port 30*a* fills the region 32*c*, and then flows preferentially through the longer, second passage 30*b* due to the aforementioned difference in flow resistance, thereby filling the region 32*d*. Accordingly, air that has existed within the cavity 32 before the ink introduction is pushed by ink flowing through the second passage 30*b* and smoothly moved toward the outlet port 31*b*, to be discharged through the outlet port 31*b*.

Next, referring to FIG. 9B, a description will be given to how ink flows within the cavity 32 of the pump 30 during a printing operation. While the ink-jet heads 1 are performing a printing operation, the rotor 40 is kept in the print position as shown in FIGS. 3, 6A, and 7A. At this time, the partition 50 partitions the cavity 32 into a region 32*a* in which the inlet port 31*a* and the outlet port 31*b* exist and a region 32*b* in which neither the inlet port 31*a* nor the outlet port 31*b* exists. The cut-off portion 42 is located in the region 32*a* in which the inlet port 31*a* and the outlet port 31*b* exist, and the rotator 40*a* is in no contact with the housing 31. Both ends of the partition 50 are, instead of confronting the recess 34, in contact with the inner face of the housing 31.

When the rotor 40 is in the print position, a flow resistance in the first passage 30*a* is very low because a relatively large space appears above the cut-off portion 42. In the second passage 30*b*, on the other hand, both ends of the partition 50 are in contact with the inner surface of the housing 31. Thus, a flow resistance in the second passage 30*b* is higher than that in the first passage 30*a*.

During the printing operation, ink having introduced from the inlet port 30*a* flows preferentially through the shorter, first passage 30*a* to reach the outlet port 30*b* due to a difference in flow resistance. As a result, for ink ejections from the ink-jet head 1, required ink is naturally supplied from the ink cartridge 20 via the pump 30 to the ink-jet head 1. Thus, ink can smoothly be supplied to the ink-jet head 1.

Next, referring to FIG. 9C, a description will be given to how ink flows within the cavity 32 of the pump 30 at the time of dismounting the ink cartridge 20 from the receiver 3. Prior to dismounting the ink cartridge 20, the rotor 40 is moved into the dismount position as shown in FIGS. 7B and 7C. During a dismounting operation, the rotor 40 is kept in the dismount position. When the rotor 40, which is in the introduction position as shown in FIG. 9A, is slightly rotated in the counterclockwise direction, the rotor 40 comes in the dismount position. At this time, the partition 50 partitions the cavity 32 into a region 32*e* in which the inlet port 31*a* exists and a region 32*f* in which the outlet port 31*b* exists, which is the same as in the above-described case where the rotor 40 is in the introduction position. As in the case where the rotor 40 is in the introduction position, further, the cut-off portion 42 is located in the region 32*f* in which the outlet port 31*b* exists, and the peripheral surface of the rotator 40*a* is in contact with the inner surface of the housing 31. One end of the partition 50 is disposed in this contact area. However, differently from the case where the rotor 40 is in the introduction position, the other end of the partition 50 does not confront the recess 34 but is slightly shifted therefrom in an upper-right direction, and in this position the other end of the partition 50 is in contact with the inner surface of the housing 31.

When the rotor 40 is in the dismount position, a flow resistance in the first passage 30*a* is very high because the peripheral surface of the rotator 40*a* and one end of the partition 50 are in contact with the inner surface of the housing 31, which is the same as in the case where the rotor 40 is in the introduction position. On the other hand, a flow resistance in the second passage 30*b* is higher than that in the case where the rotor 40 is in the introduction position (see FIG. 9A). This is because the other end of the partition 50 does not confront the recess 34 but is in contact with the inner surface of the housing 31. Consequently, the sum of the flow resistances in the first and second passages 30*a* and 30*b* is much higher than that in the case where the rotor 40 is in the print position (see FIG. 9B).

In comparison between the flow resistance in the first passage 30*a* and the flow resistance in the second passage 30*b* which are obtained when the rotor 40 is in the dismount position, the flow resistance in the first passage 30*a* is higher than the flow resistance in the second passage 30*b*. This is because not only the partition 50 but also the rotator 40*a* are in contact with the housing 31 in the first passage 30*a*, whereas only the partition 50 is in contact with the housing 31 in the second passage 30*b*.

Figure 9C:
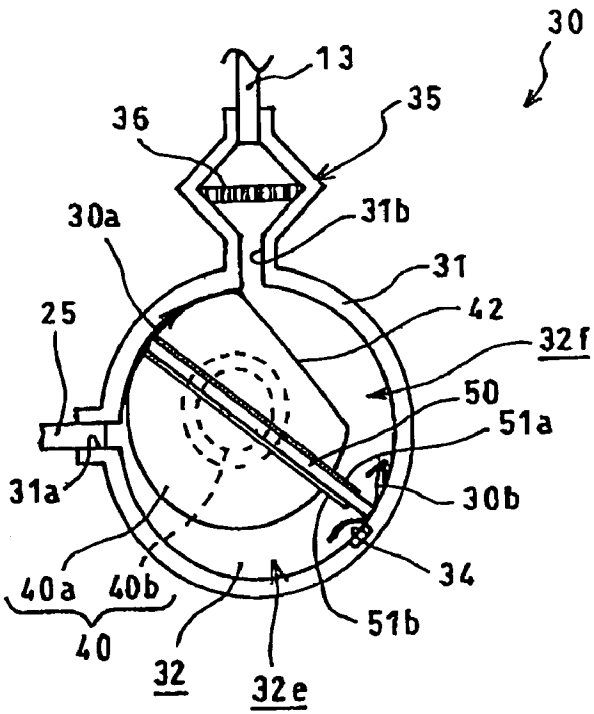
FIG. 9C is a sectional view showing a state of the pump at the time of dismounting the ink cartridge from the receiver.
Figure 9B:
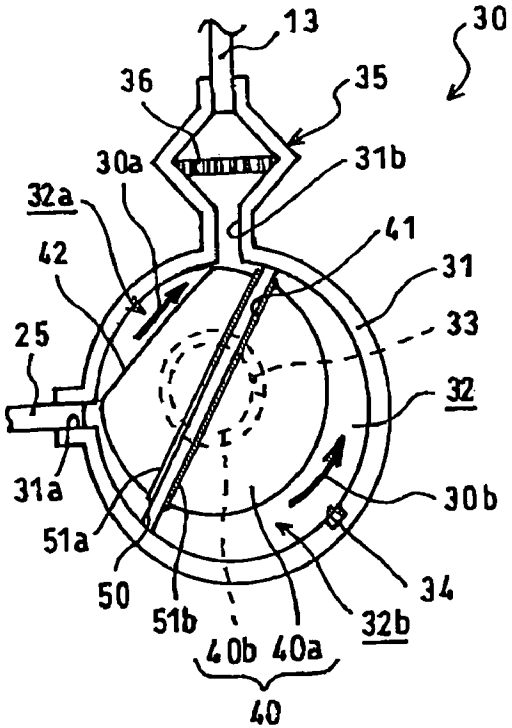
FIG. 9B is a sectional view showing a state of the pump during a printing operation.
Figure 9A:
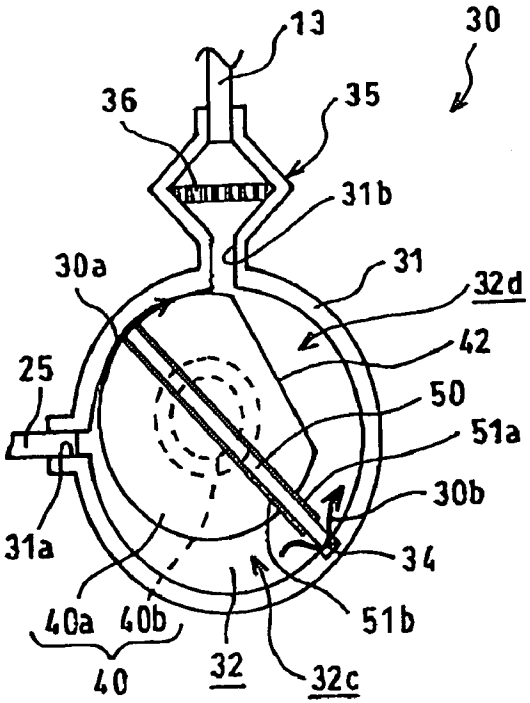
FIG. 9A is a sectional view showing a state of the pump at the time of initial ink introduction.

When the rotor 40 is in the respective three positions as described above, the flow resistances in the first and second passages 30*a* and 30*b* satisfy the following formulas:

$$R1>R2 \quad (1a);$$

$$R10<R20 \quad (2);$$

$$R100>R200 \quad (1b);$$

$$R2/R1<R20/R10 \quad (3a);$$

$$R200/R100<R20/R10 \quad (3b);$$

$$R10<R1 \quad (4a);$$

$$R10<R100 \quad (4b); \text{ and}$$

$$R100+R200>R10+R20 \quad (5),$$

where R1, R10, and R100 represent a flow resistance in the first passage 30*a* and R2, R20, and R200 represent a flow resistance in the second passage 30*b*, when the rotor 40 is in the introduction position as in FIG. 9A, in the print position as in the FIG. 9B, and in the dismount position as in the FIG. 9C, respectively.

As has been described above, the ink-jet printer 101 of this embodiment does not adopt such a system that a tube disposed within a pump is subjected to repeated pressurization and depressurization. Therefore, the pump 30 has a relatively simple construction, and at the same time the pump 30 is unlikely to incur a failure that would otherwise be caused by, e.g., damage on a tube. Thus, the ink-jet head 1 can be prevented from seeing a defective ink supply that would be caused by a failure of the pump 30.

In addition, based on the results of detections by the proximity sensors 47 and 48, the partition 50 is disposed within a predetermined range prior to starting the initial ink introduction into the cavity 32, and then ink is introduced into the cavity 32 with the partition 50 being kept within the aforesaid predetermined range. Thereby, air bubbles are unlikely to arise within the cavity 32. In this embodiment, the rotor 40 that supports the partition 50 is kept in the introduction position (see FIG. 9A) during the initial ink introduction. When the rotor 40 is in the introduction position, the flow resistance R1 in the first passage 30*a* is higher than the flow resistance R2 in the second passage 30*b* (R1>R2). If the flow resistance R1 in the first passage 30*a* was lower than the flow resistance R2 in the second passage 30*b* (R1<R2), ink could not flow well into the longer second passage 30*b*, thus failing to move air toward the outlet port 31*b*. As a result, the air would be mixed into the ink, and air bubbles might arise within the cavity 32. In this embodiment, however, air is pushed by ink and smoothly moved toward the outlet port 31*b*. Therefore, air bubbles are unlikely to arise within the cavity 32.

In this embodiment, the flow resistances in the first and second passages 30*a* and 30*b* satisfy not only the formula "R1>R2 (1*a*)", but also the formulas "R2/R1<R20/R10 (3a)" and "R10<R1 (4a)". When the rotor 40 that supports the partition 50 is positioned so as to satisfy at least one of the three formulas (1a), (3a), and (4a), air bubbles can be prevented from arising within the cavity 32 at the time of the initial ink introduction.

Further, based on the results of detections by the proximity sensors 47 and 48, the partition 50 is disposed within a predetermined range prior to dismounting the ink cartridge 20 from the pump 30 and more specifically from the receiver 3, and then the ink cartridge 20 is dismounted from the pump 30 with the partition 50 being kept within the aforesaid predetermined range. This can prevent breakage of meniscuses. In this embodiment, the rotor 40 that supports the partition 50 is kept in the dismount position (see FIG. 9C) during the dismounting operation for the ink cartridge 20. When the rotor 40 is in the dismount position, pressure within the cavity 32 can substantially be kept constant, because the sum of the flow resistances in the first and second passages 30*a* and 30*b* is higher than that in the case where the rotor 40 is in the print position (see FIG. 9B). During the dismounting operation, therefore, no air is introduced through the inlet port 31*a*, thus balancing pressure in the ink supply path between the ink cartridge 20 and the head 1. This can prevent breakage of meniscuses. Breakage of meniscus may cause ink leakage from the nozzles, which can however be relieved in this embodiment.

After the proximity sensor 48 detects that the rotor 40 is disposed in the introduction position, the stopper 5 is pulled out of the receiver 3 to allow the ink cartridge 20 to be mounted to the receiver 3. That is, the ink cartridge 20 cannot be mounted to the receiver 3 until the rotor 40 is disposed within the predetermined range. This can prevent ink introduction into the cavity 32 from occurring before the rotor 40 is disposed within the predetermined range.

In addition, until the rotor 40 is disposed in the dismount position, the stopper 5 is not pulled out of the opening 21*b* and therefore the ink cartridge 20 is not allowed to be dismounted from the pump 30. If the ink cartridge 20 was dismounted from the pump 30 before the rotor 40 is disposed in the dismount position, pressure in the ink supply path would fall unbalanced and meniscuses would be broken, which however can be prevented surely in this embodiment.

This embodiment can realize the above-described effects with a simple structure, by employing the stopper 5 that is movable into and out of the receiver 3 in association with results of detection by the sensors.

After the CPU 61 determines that "ink should be initially introduced into the cavity 32 of the pump 30", the proximity sensor 48 starts its detection operation. In addition, after the CPU 61 determines that "the ink cartridge should be renewed", the proximity sensors 47 and 48 start their detection operations. As a result, the sensors 47 and 48 can realize efficient detection operations.

When the rotor 40 is in the introduction position and in the dismount position, the flow resistance in the first passage 30*a* is very high because the rotator 40*a* of the rotor 40 as well as one end of the partition 50 are in contact with the inner surface of the housing 31 along the first passage 30. However, this is not limitative, and, for example, only one end of the partition 50 may be in contact with the inner surface of the housing 31 along the first passage 30*a*. In other words, the flow resistance in the first passage 30*a* may be regulated by means of, without using the rotator 40*a*, the partition 50 alone. This can further simplify the structure.

The recess 34 is formed in the inner surface of the housing 31 along the second passage 30*b*. Therefore, when the rotor 40 is in the introduction position and in the dismount position, the flow resistance in the second passage 30*b* is effectively low.

It is more preferable that, after the initial ink introduction into the cavity 32, the rotor 40 is vibrated while kept in the aforesaid predetermined range. For example, in the state of FIG. 9A that is set as a base state, the rotor 40 is rotated within ±5 degrees in the forward and backward directions at a speed of approximately 1/50 to 1/100 of a speed at which the rotor 40 rotates during a purge operation. In this case, the other end of the partition 50 takes a position confronting the recess 34 and a position contacting the inner surface of the housing 31, and therefore the other end of the partition 50 slides on a part of the surface of the housing 31 near the recess 34. Thus, the flow resistance in the second passage 30*b* is more lowered. However, the flow resistance in the first passage 30*a* does not vary so much. Accordingly, a difference in flow resistance between the first passage 30*a* and the second passage 30*b* becomes larger, thus further enhancing the effect that air bubbles are unlikely to arise within the cavity 32.

Figure 10B:
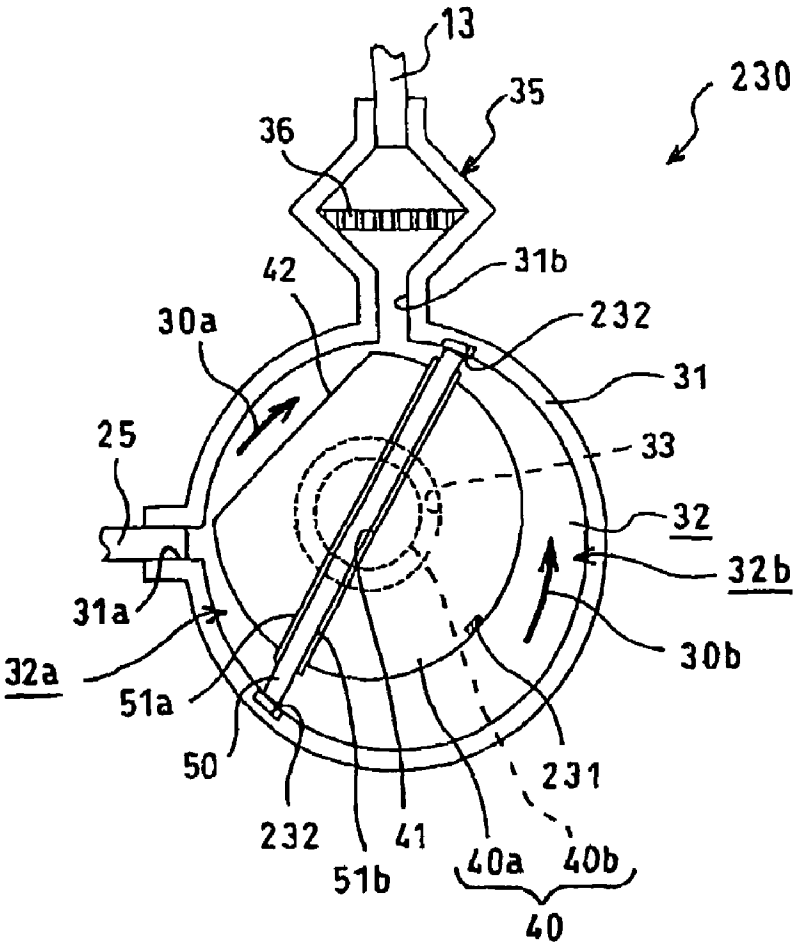
FIGS. 10A and 10B are sectional views showing a first modification of the pump which is applicable to the ink-jet printer according to the present invention.
Figure 10A:
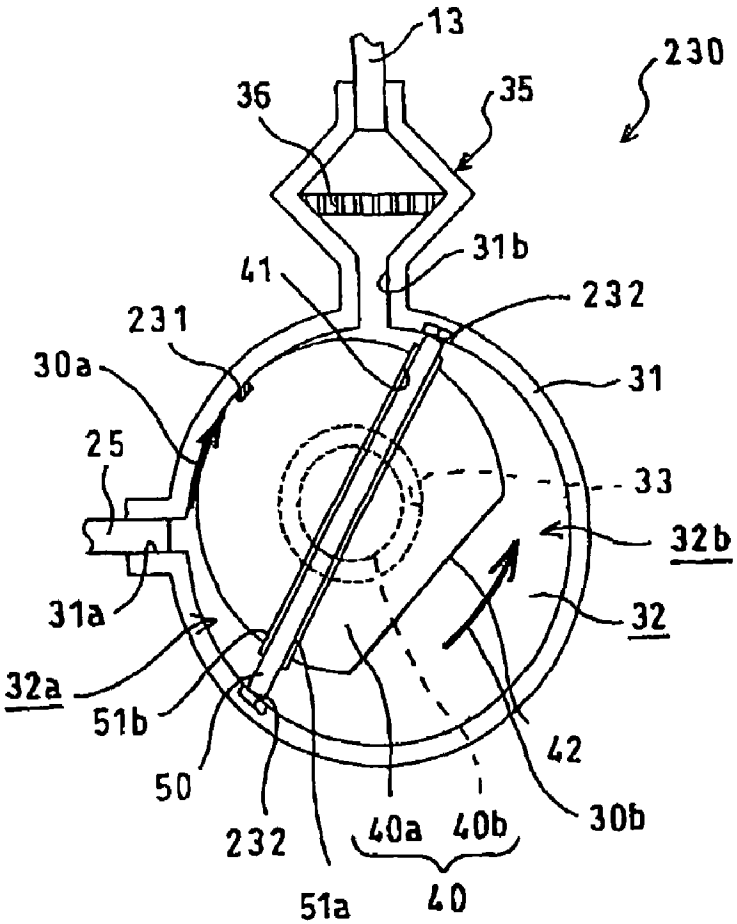

Then, referring to FIGS. 10A and 10B, a description will be given to a first modification of a pump, which is applicable to the ink-jet printer 101 of this embodiment. FIG. 10A is a sectional view showing a state of a pump at the time of an initial ink introduction. FIG. 10B is a sectional view showing a state of the pump during a printing operation. Here, the same members as of the above-described pump 30 will be denoted by the common reference numerals, and descriptions thereof will be omitted.

A pump 230 according to this modification has substantially the same structure as that of the above-described pump 30, but differs therefrom in that a sealer 231 is provided on the peripheral surface of the rotator 40*a* of the rotor 40, and in that two recesses 232 are formed in the inner surface of the housing 31.

When the rotor 40 is in an introduction position as shown in FIG. 10A, the partition 50 partitions the cavity 32 in a different manner from in the above-described pump 30 (see FIG. 9A). That is, the partition 50 partitions the cavity 32 into a region 32*a* in which the inlet port 31*a* and the outlet port 31*b* exist and a region 32*b* in which neither the inlet port 31*a* nor the outlet port 31*b* exists. Both ends of the partition 50 are disposed in the second passage 30*b* and confront the respective recesses 232. The cut-off portion 42 is located in the region 32*b* in which neither the inlet port 31*a* nor the outlet port 31*b* exists. The peripheral surface of the rotator 40*a* is in contact with the inner surface of the housing 31 along the first passage 30*a*. The sealer 231 is disposed in this contact area.

At this time, a flow resistance in the first passage 30*a* is very high, because the peripheral surface of the rotator 40*a* is in contact with the inner surface of the housing 31 and, moreover, the sealer 231 is disposed in this contact area. In the second passage 30*b*, on the other hand, ink can flow relatively smoothly to the outlet port 31*b* via the recesses 232, because both ends of the partition 50 confront the respective recesses 232. At this time, therefore, the flow resistance in the first passage 30*a* is higher than the flow resistance in the second passage 30*b*.

When the rotor 40 is in a print position as shown in FIG. 10B, the partition 50 partitions the cavity 32 in the same manner as in the above-described pump 30 (see FIG. 9B). That is, the partition 50 partitions the cavity 32 into a region 32*a* in which the inlet port 31*a* and the outlet port 31*b* exist and a region 32*b* in which neither the inlet port 31*a* nor the outlet port 31*b* exists. The cut-off portion 42 is located in the region 32*a* in which the inlet port 31*a* and the outlet port 31*b* exist, and the rotator 40*a* is in no contact with the housing 31. As a result, the flow resistance in the first passage 30*a* is very low, so that ink can smoothly be supplied to the ink-jet head 1.

When the rotor 40 is in the print position, in the above-described pump 30 (see FIG. 9B), both ends of the partition 50 are in contact with the inner surface of the housing 31, whereas, in this modification both ends of the partition 50 confront the respective recesses 232. At this time, accordingly, the flow resistance in the second passage 30*b* in this modification is lower than that in the above-described pump 30, so that ink flows in the second passage 30*b* as well as the first passage 30*a*.

A dismount position of the rotor 40 in this modification corresponds to the introduction position of the rotor 40 in the above-described embodiment (see FIG. 9A). In the first passage 30*a*, the peripheral surface of the rotator 40*a* and one end of the partition 50 are in contact with the inner surface of the housing 31. In the second passage 30*b*, since the location of the recess is different from that in the above-described embodiment, the other ends of the partition 50 is in contact with the inner surface of the housing 31. In this state, the flow resistance in the first passage 30*a* and the flow resistance in the second passage 30*b* are substantially equal to those obtained when the rotor 40 is in the dismount position in the above-described embodiment. Thus, the sum of the flow resistances in the first and second passages 30*a* and 30*b* is much higher than that in the case where the rotor 40 is in the print position (see FIG. 10B).

Figure 11B:
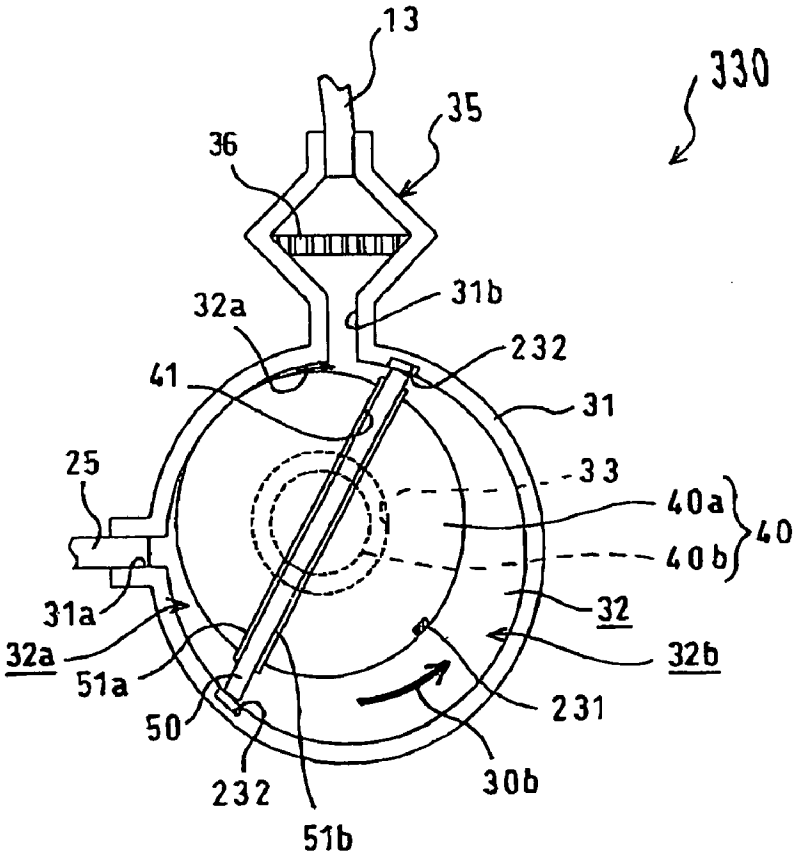
FIGS. 11A and 11B are sectional views showing a second modification of the pump, which is applicable to the ink-jet printer according to the present invention.
Figure 11A:
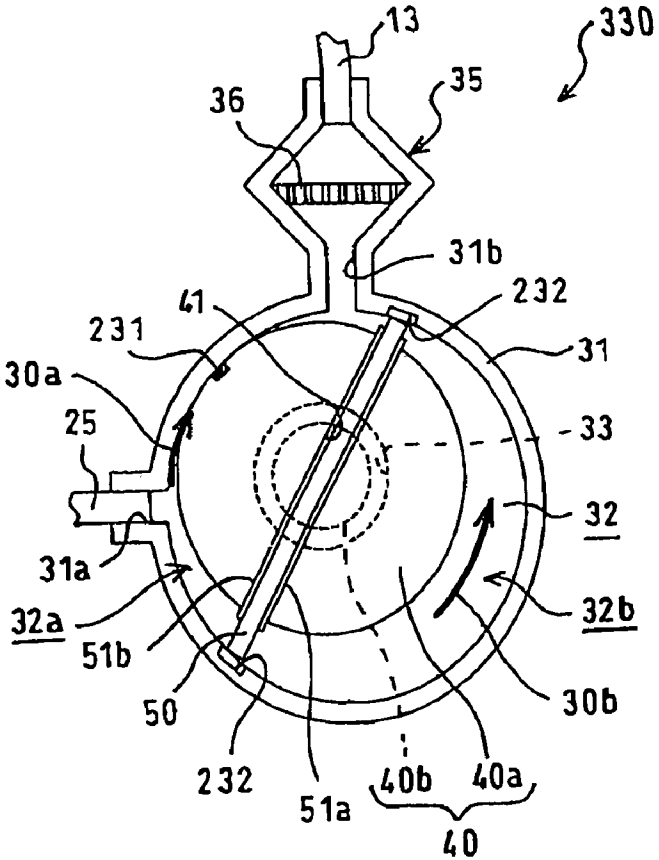

Next, referring to FIGS. 11A and 11B, a description will be given to a second modification of a pump, which is applicable to the ink-jet printer 101 of this embodiment. FIG. 11A is a sectional view showing a state of a pump at the time of an initial ink introduction. FIG. 11B is a sectional view showing a state of the pump during a printing operation. Here, the same members as described above will be denoted by the common reference numerals, and descriptions thereof will be omitted.

A pump 330 according to this modification has substantially the same structure as that of the pump 230 of the first modification (see FIGS. 10A and 10B), but differs therefrom only in that the rotor 40 has no cut-off portion 42.

When the rotor 40 is in an introduction position as shown in FIG. 11A, the partition 50 partitions the cavity 32 in the same manner as in the first modification (see FIG. 10A). That is, the partition 50 partitions the cavity 32 into a region 32*a* in which the inlet port 31*a* and the outlet port 31*b* exist and a region 32*b* in which neither the inlet port 31*a* nor the outlet port 31*b* exists. Both ends of the partition 50 are disposed in the second passage 30*b* and confront the respective recesses 232. The peripheral surface of the rotator 40*a* is in contact with the inner surface of the housing 31 along the first passage 30*a*. The sealer 231 is disposed in this contact area.

At this time, similarly to the first modification, a flow resistance in the first passage 30*a* is very high. On the other hand, a flow resistance in the second passage 30*b* is, because the recess 232 is provided, lower than the flow resistance in the first passage 30*a*.

When the rotor 40 is in a print position as shown in FIG. 11B, the partition 50 partitions the cavity 32 in the same manner as in the first embodiment (see FIG. 10B). That is, the partition 50 partitions the cavity 32 into a region 32*a* in which the inlet port 31*a* and the outlet port 31*b* exist and a region 32*b* in which neither the inlet port 31*a* nor the outlet port 31*b* exists. However, this modification differs from the first modification in that the peripheral surface of the rotator 40*a* is in contact with the inner surface of the housing 31 along the first passage 30*a*. Although the first passage 30*a* in this modification is narrower than that in the first modification, absence of the sealer 231 in the first passage 30*a* would relatively lower the flow resistance in the first passage 30*a*, so that ink can smoothly be supplied to the ink-jet head 1. In the second passage 30*b*, as in the first embodiment, both ends of the partition 50 confront the respective recesses 232. Accordingly, the flow resistance in the second passage 30*b* is relatively low. Therefore, ink flows in the second passage 30*b* as well as the first passage 30*a*.

A dismount position of the rotor 40 in this modification corresponds to the introduction position of the rotor 40 in the above-described embodiment (see FIG. 9A), as in the first modification. In this case, accordingly, the flow resistance in the first passage 30*a* and the flow resistance in the second passage 30*b* are substantially equal to those obtained when the rotor 40 is in the dismount position in the above-described embodiment. Thus, the sum of the flow resistances in the first and second passages 30*a* and 30*b* is much higher than that in the case where the rotor 40 is in the print position (see FIG. 10B).

In the above-described first and second modifications as well, when the rotor 40 is in the respective three positions as described above, the flow resistances in the first and second passage 30*a* and 30*b* satisfy the aforementioned formulas (1a), (1*b*), (2), (3*a*), (3*b*), (4*a*), (4*b*), and (5), with the same effects as described above.

In the first and second modifications, when the rotor 40 is in the introduction position, both ends of the partition 50 are disposed in the second passage 30*b* and, in addition, the rotator 40*a* is in contact with the inner surface of the housing 31 along the first passage 30*a*. Like this, the flow resistances in the first and second passages 30*a* and 30*b* can surely be regulated using both of the partition 50 and the rotator 40*a*.

In the first and second modifications, moreover, the recesses 232 are formed in the inner surface of the housing 31 along the second passage 30*b* such that the recesses 232 can confront the respective ends of the partition 50 when the rotor 40 is in the introduction position. Thereby, the flow resistance in the second passage 30*b* is effectively low.

Further, the sealer 231 provided on the peripheral surface of the rotor 40 is brought into contact with the inner surface of the housing 31, thereby allowing the flow resistance in the first passage 30*a* to become very high when the rotor 40 is in the introduction position.

The partition 50 and the rotor 40 may be disposed at various positions, insofar as, during the initial ink introduction, the flow resistances in the first and second passages 30*a* and 30*b* satisfy at least any one of the above three formulas (1a), (3*a*), and (4*a*).

The flow resistance in the first and second passages 30*a* and 30*b* can be regulated by means of various elements instead of the cut-off portion 42 and the sealer 231 provided in the rotator 40*a* and the recess 34 or 232 formed on the housing 31.

It is also possible to replace the cut-off portion 42 formed in the rotator 40*a* with a through-hole and to dispose the rotor 40 in such a manner that the through-hole may constitute a part of the first passage 30*a* during a printing operation. In this case as well, the flow resistance in the first passage 30*a* becomes very low during the printing operation.

The stopper 5, the arm 6, and the solenoid valve 7 can be omitted.

A means for detecting a rotational state of the rotor 40, which includes a position of the partition 50, is not limited to the proximity sensors 47 and 48, but may be other sensors such as an angle sensor which realize detections in various manners.

It is also possible to provide a pressure sensor in the ink supply path between the ink cartridge 20 and the head 1 and, prior to reaching such pressure as to break meniscuses, to dispose the rotor 40 and the partition 50 within the predetermined range. This can more surely prevent breakage of meniscuses during an operation for dismounting the ink cartridge 20.

An application of the present invention is not limited to line-type ink-jet printers. The present invention is also applicable to, for example, serial-type ink-jet printers, ink-jet type facsimile machines or copying machines.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A method for controlling an ink-jet recording apparatus comprising:

a pump that includes a housing, a rotor, a partition, a first passage, and a second passage, the housing having a cavity formed therein and also having an inlet port through which ink is sucked into the cavity and an outlet port through which ink is discharged out of the cavity, the rotor being rotatable within the cavity, the partition being, together with the rotor, rotatable within the cavity while being supported on the rotor such that both ends thereof can be in contact with an inner surface of the housing, the first passage being formed within the cavity and extending from the inlet port to the outlet port, the second passage being formed within the cavity to be longer than the first passage and extending from the inlet port to the outlet port via a side of the rotor opposite to the first passage; and an ink-jet head to which ink is supplied from the pump, the method comprising steps of:

rotating the partition within a predetermined range of positions so that a flow resistance in the first passage is higher than a flow resistance in the second passage; and starting an initial ink introduction into the cavity, the partition being maintained within the predetermined range during the initial ink introduction.

2. The method according to claim 1, further comprising a step of, after starting the initial ink introduction, vibrating the partition disposed within the range.

3. The method according to claim 1, wherein the step of starting the initial ink introduction includes moving an ink supply member that supplies ink to the pump into an ink suppliable position.

* * * * *